United States Patent [19]

Anderson

[11] Patent Number: 4,797,077

[45] Date of Patent: Jan. 10, 1989

[54] ROTARY EXPANSIBLE CHAMBER DEVICE

[76] Inventor: Dean R. G. Anderson, 1306 W. Bluff Rd., Syracuse, Utah 84121

[21] Appl. No.: 655,357

[22] Filed: Sep. 27, 1984

[51] Int. Cl.[4] ..... F01C 1/14

[52] U.S. Cl. ..... 418/201; 418/206

[58] Field of Search ..... 418/191, 201, 206

[56] References Cited

U.S. PATENT DOCUMENTS

| | | | |
|---|---|---|---|
| 2,266,820 | 12/1941 | Smith | 418/201 |
| 2,515,201 | 7/1950 | Dulmage | 418/201 |
| 2,652,192 | 9/1953 | Chilton | 418/150 |
| 3,807,911 | 4/1974 | Caffrey | 418/201 |
| 3,814,557 | 6/1974 | Volz | 418/201 |
| 4,033,708 | 7/1977 | Weatherston | 418/206 |

FOREIGN PATENT DOCUMENTS

| | | | |
|---|---|---|---|
| 2944714 | 5/1981 | Fed. Rep. of Germany | 418/201 |
| 394593 | 12/1965 | Switzerland | 418/201 |

*Primary Examiner*—William L. Freeh

*Attorney, Agent, or Firm*—Thorpe, North & Western

[57] ABSTRACT

A rotary expansible chamber device capable of functioning as a compressor or fluid motor is made up of a housing containing two or more parallel working chambers wherein each chamber contains an impeller. Adjacent impellers mate with each other and the housing in a fluid tight relationship with each impeller being made up as a multiplicity of risers of uniform cross section wherein each riser has one or more lobes and one of more adjacent wells. The risers along each impeller are axially offset from each other in a spiraling relationship with each impeller containing risers of at least two different heights. As the impellers rotate, a compressible gas is forced to travel axially along the working chambers through the riser wells. As the compressible gas travels through the working chambers it becomes sealed within adjacent wells along an impeller in the form of a stepped spiral gas volume. The sealed volume will change in size as it travels along the axial length of the impeller as a function of impeller rotation and change in riser height.

17 Claims, 9 Drawing Sheets

ROTARY EXPANSIBLE CHAMBER DEVICE

BACKGROUND OF THE INVENTION

1. Field of the Invention

This invention relates to a rotary expansible chamber device useful for the compression and/or expansion of compressible fluids. More particularly, this invention relates to a rotary expansible chamber device useful as a compressor, wherein a compressible fluid is compressed within the device, or as a fluid motor, wherein a compressed fluid is expanded and converted into mechanical energy.

2. Description of the Prior Art

Rotary prior art devices useful for either compressor or fluid motor functions have traditionally consisted of either a screw type compressor or Roots-type blower. Generally, if compression is to occur within the device itself, both types have required either timed inlet and outlet ports or transverse gas flow.

U.S. Pat. Nos. 3,941,521; 4,033,708; 4,076,469 and 4,437,818 are drawn to Roots-type compressors with "precompression" taking place within the working chambers. To accomplish the precompression feature the devices function such that the impellers are open to intake air along the entire axial length thereof and precompression takes place by the rotating of the impellers until the impellers reach a point where further rotation thereof causes a valving action of the gases through a port in the wall of the housing. This compression is theoretically adiabatic. However, once the precompression air in the impellers becomes freely communicating with the outlet port in the housing wall further rotation of the impellers constitutes a nonadiabatic compression at a constant pressure. The flow path in these devices is essentially transverse to the axial plane of the impellers and it is taught that limiting the axial length of the impellers to the minimum number of profiles or risers on each impeller prevents costly axial leakage and improves the efficiency of the compressor.

Screw compressors which provide for sealed axial flow of a compressible gas are shown in U.S. Pat. Nos. 1,735,477 and 2,652,192. These screw-type compressors exhibit good theoretical adiabatic compression efficiency; however, because of the high number of knife edge seals and the three dimensional construction required they are considered to be high leakage devices and are complicated and expensive to manufacture.

While the above devices have been considered as compressors they could function as fluid motors by reversing the fluid flow through them but would have the same disadvantages.

In none of the above cited patents is there taught an efficient compressor or fluid motor consisting of intermeshing, impellers which are capable of adiabatic compression or expansion of compressible gases by means of axial flow of sealed volumes therethrough.

Additional patents considered which have one or more parts somewhat similar in design or function to one or more parts of the invention to be described are found in U.S. Pat. Nos. 158,277; 3,865,524 and 3,938,915.

SUMMARY OF THE INVENTION

A rotary expansible chamber device which overcomes many of the problems associated with prior art devices is provided by the present invention. This device can be made to function as a compressor or fluid motor by modifying the arrangement of the rotating, mating impellers which are contained in a parallel relationship within parallel working chambers. Other uses will also be apparent by the following description and drawings.

The device consists of a housing defining two or more parallel, communicating cylindrical working chambers; each chamber containing a stepped impeller rotatably mounted therein such that each impeller mates with the impeller in an adjoining chamber. Each of the stepped impellers consists of a plurality of risers having an outer and inner radius. Each riser has a constant cross section and the circumferential area between the inner and outer radius is made up of one or more lobes and wells. The outer circumferential surface of the lobes sealingly engages the sidewalls of the working chambers. In other words, the outer radius of each riser and the radius of each working chamber is the same taking into consideration the fact that there must be sufficient clearance between the outer lobe surface and the working chamber walls to allow free rotation of the impellers.

The inner radius of the risers defines the floor of each well. The sidewalls of each well are concave with the beginning of each sidewall at the inner radius and the ending of each sidewall at the tip of the lobe on the outer radius being on the same radial line extending from the axial center of each riser to the outer radius.

Each riser has at least one lobe and one well, with two or three lobes and wells being preferable. The risers of each impeller are arranged such that the lobes of any one riser are angularly displaced from those of the risers immediately adjacent thereto in a spiraling relationship opposite the direction of impeller rotation in the direction of gas flow therethrough with the wells of adjacent risers communicating. The adjacent lobes are thereby arranged as in a spiral staircase with the transverse sections thereof serving as angular treads.

Within a given compressor or expansion function the height and/or angular tread of the risers at each impeller section are different from the height and/or angular tread of the risers of another section for that function. The difference in height or tread may be varied continually from one end to the other within that function or may consist of two or more series of risers with the height or tread of the risers of each series being the same but different from the height or tread of the risers in an adjacent series. The risers are angularly offset such that, within the compressor or expander function, there will be at least one completely sealed spiral of wells along at least one impeller defining a stepped sealed helical volume which sealed volume will change in size as a function of angular rotation.

Each impeller has an identical set of risers and the impellers are arranged in a mating relationship such that the lobes of one riser on an impeller will mate into the wells of the riser in an adjacent impeller as will be more fully described.

The impellers rotate in opposite directions and within a given number of risers there will be created within at least one impeller a sealed, stepped helical volume of a compressible gas which changes in size as it axially moves along the impeller as a function of impeller rotation and difference in riser height. In a compressor situation the gas will move axially from the larger series of well volumes toward the smaller series of well volumes and the sealed volume will decrease in size. In the fluid motor operation the axial flow will be just the opposite and the sealed volume will expand. Thus, in the present invention, the compressible gases flow axially and sequentially into the wells volume formed between the rotating impellers and their respective housing and, upon rotation of the impellers, a volume of gas becomes trapped within a single closed stepped, helical pocket, and progresses axially along the length of the impellers and working chambers. The invention therefore comprises the combination and arrangement of parts as herein set forth and their methods of use, the scope thereof being limited only by the appended claims.

BRIEF DESCRIPTION OF THE DRAWINGS

A more complete understanding of the invention may be had with reference to the following detailed description taken in connection with the accompanying drawings herein.

DETAILED DESCRIPTION OF THE INVENTION

Figure 1:
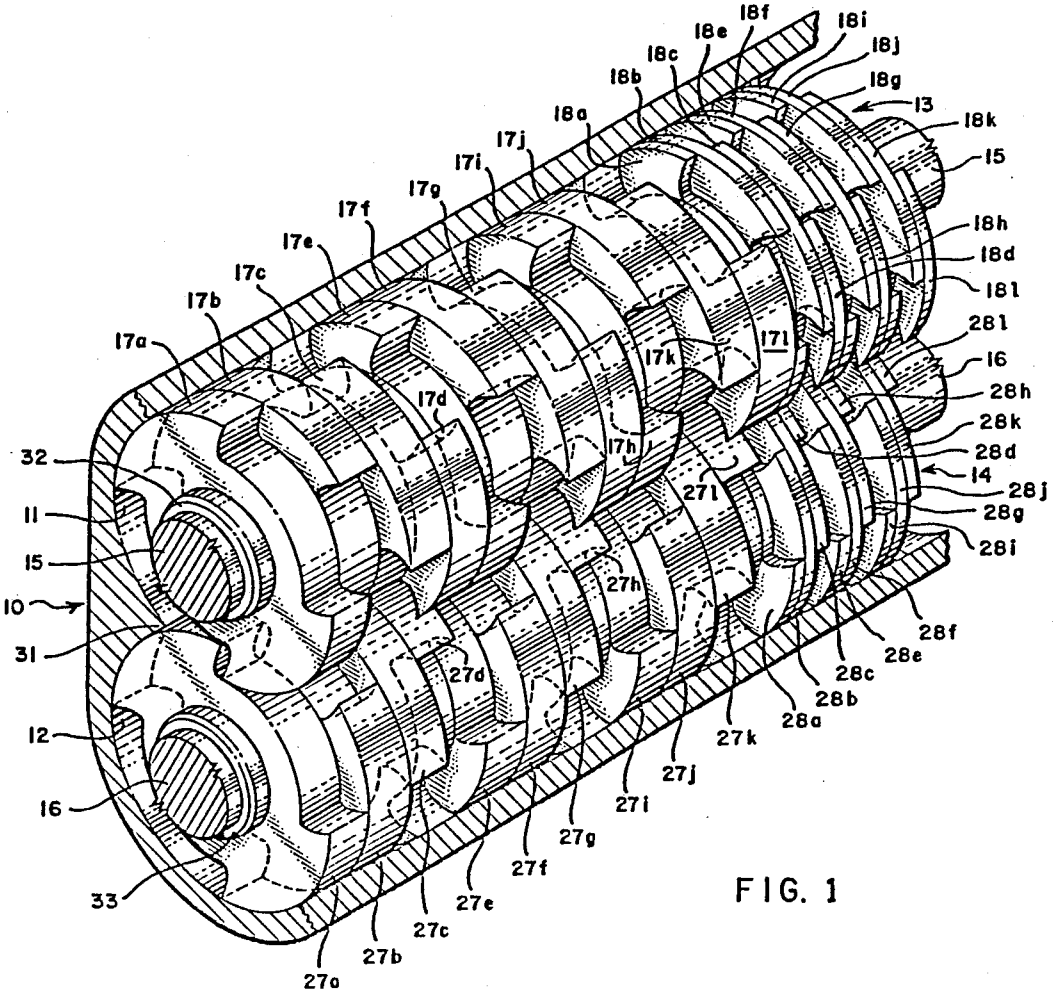
FIG. 1 is a pictorial cut away side view of one embodiment of an expansible chamber device, with the end portions of the casing removed to better show the impellers.

In the following description it is often necessary to simultaneously describe portions of meshing risers of adjacent impellers or to describe two or more risers on the same impeller which are axially offset from each other. This makes the placing of numerals on the drawings somewhat difficult as a well in one riser will be followed by a tread (lobe portion) of an underlying riser. As shown in the drawings a well in one riser may be divided into two volumes by the lobe of an adjacent riser. At times it may be necessary to refer to the complete well as if it were undivided while also referring to the divided portions. However, the description and drawings will be readily understandable to one of ordinary skill in the art by reference to the numerals and the description thereof. It will therefore be apparent from the numerals whether reference is being made to a well in one riser or an underlying lobe in the next axial riser. It will also be equally apparent by reference to the numerals whether reference is being made to a divided well volume or the complete well.

Referring now to FIGS. 1–8 of the drawings, an expansible chamber device in a compressor function is shown as comprising a housing 10, having two interconnecting, parallel, cylindrical working chambers 11 and 12 within which are disposed parallel, intermeshing stepped impellers 13 and 14 with the steps being made up of a plurality of risers as will be described.

Impellers 13 and 14 are shown as each being made up of two separate series of risers. Series 17 and 18 on impeller 13 are mounted on shaft 15 and series 27 and 28 on impeller 14 are mounted on shaft 16. Each series contains separate risers identified by letters "a" through "l". Shafts 15 and 16 are supported at each end by their receptive bearings 21, 22, 23 and 24, carried by housing 10. These shafts and bearings may be shielded from contact with the outside environment by means of washers 47 and 48 and end plate 49. Except as shown in FIG. 1, the impellers are illustrated as being made up of separate risers. However, it is possible that each impeller could be formed from a solid piece of material or that the riser portions could be formed from one piece of material having a central aperture through which a shaft is inserted. As far as the present invention is concerned all variations are equivalent and are considered to be within the scope of the invention. For purposes of explanation it is easier to describe each riser as if it were a separate unit.

Each impeller 13 and 14 is provided with a series of stepped risers. Risers 17 *a–l* through 18 *a–l* are located about shaft 15 in a stepped relationship and risers 27 *a–l* through 28 *a–l* are located about shaft 16, also in a stepped relationship. The risers, when separately mounted, are secured to their respective shafts by keys 64 and 65 and held in place by locking collars 32, 33, 34 and 35.

Each riser has the same transverse cross section but is angularly displaced from adjacent risers in a spiraling relationship as will be described. Because the cross section of each riser in the preferred embodiment is identical, reference will be made to a single cross section in describing the risers with the knowledge that any transverse cross sections taken axially anywhere along the riser areas of the impellers would be the same in the same position of rotation.

Figure 3:
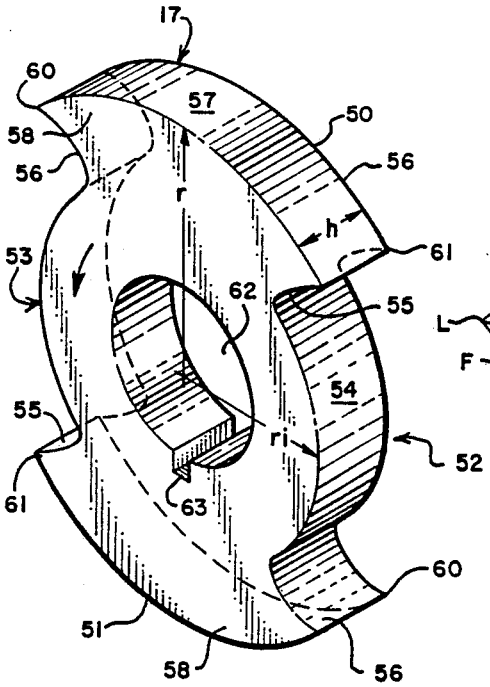
FIG. 3 is a pictorial view of single riser section of an impeller illustrating the arrangement of the lobes and wells and surface areas thereof.

Riser 17, as shown in FIG. 3, is representative of all risers and is comprised of two lobes 50 and 51 and two wells 52 and 53. Each riser must have at least one lobe and one well and may have two or more lobes dividing two or more wells. For purposes of illustration two lobes and two wells have been chosen. In practice it is believed two or three lobes and wells will be preferable although more or less may be used.

Each separate riser is cylindrical having an outer radius "r" extending from the axial center to the outer perimeter of the lobes as shown in FIG. 3 and an inner radius "$r_i$" extending from the axial center to the floor perimeter of the wells as also shown in FIG. 3. Each riser has an axial height "h" as shown in FIG. 3 which may vary as will be described. Each well 52 and 53 has an arcuate floor area 54 formed by a circular perimeter line of radius ri and riser height h. On either side of floor 54 are concave sidewalls 55 and 56 extending from the floor to the outer tips or edges 60 and 61 of the lobes 50 and 51. The lobes 50 and 51 have an outer perimeter area 57 defined along a circular perimeter line of radius r and riser height h. The surface area 57 of the lobes 50 and 52 will sealingly engage the interior surfaces of working chambers 11 and 12 as impellers 13 and 14 rotate therein. If each riser were a separate disk it would have flat front and back surfaces 58 and 59 respectively. However, since risers are angularly stacked, surfaces 58 and 59, depending on which way the impeller is viewed, will appear only as treads such as on a spiraling staircase. Hence, surfaces 58 and 59 will simply be referred to as treads. The tips 60 and 61 of each lobe 50 or 51 are numbered according to which tip leads in the direction of rotation and are defined as leading edge 60 and trailing edge 61. Riser 17 is shown as containing a central shaft opening 62 and a key slot 63.

The impellers are aligned such that, as they rotate in opposite directions, lobes 50 and 51 of one riser in an impeller will mate with and engage wells 52 and 53 of its parallel counterpart riser in an adjacent impeller. This mating relationship is shown in FIGS. 4 a, b, c and d which is a transverse cross section of the compressor taken along lines **4*a*—4*a*, 4*b*—4*b*, 4*c*—4*c*, and 4*d*—4*d* of FIG. 2 respectively. As illustrated, the adjacent risers *a–d* of series 17 are secured by key 64 to shaft 15 and mate with risers *a–d* of series 27 respectively which are secured by key 65 to shaft 16. Impeller 13 rotates counterclockwise as indicated and impeller 14 rotates in a clockwise direction. Relative to the direction of gas flow, adjacent risers along impeller 13 are angularly offset from each other 45° in a clockwise direction and adjacent risers along impeller 14 are angularly offset 45° in a counterclockwise direction. It is evident that lobes 50 and 51 and wells 52 and 53 of each successive riser spiral along the length of the impeller in a direction opposite the direction of impeller rotation, when viewed from left to right, which is the direction of gas flow, as best shown in FIG. 1. Thus, if one could look axially along the impellers without vision being impeded one would successively and repeatedly see the cross sections of FIG. 4*a*, 4*b*, 4*c* and 4*d* and the formation of successive stepped helical well volumes 53 and 52. However, for every 180° rotation the positions of lobes 50 and 51 and wells 53 and 52 would be reversed. Since each portion of the risers has been described in some detail in FIG. 3 only those numerals necessary to describe the functioning of the impellers will be utilized in describing FIGS. 4*a–d* and 5*a–l*. However, shafts, keys, lobes, wells, sidewalls, edges and the like may be appropriately numbered for purposes of clarity and completeness even though not specifically referred to in reference to each drawing. The riser numerals are followed by letters a, b, etc., to coincide with the riser position in the riser series being described. Only risers 17*a–g* and 27*a–g*** will be described in position and sequence since such description will also hold true for the remaining risers and riser series.

FIG. **4*a* shows a cross section of risers 17*a* and 27*a* and the visible portions of angularly offset risers 17*b*, 17*c* and 17*d* and 27*b*, 27*c* and 27*d* with the underlying portion of offset risers 17*b* and 27*b* being shown in dotted lines. Sidewall 55*a* of wells 52*a* and 53*a* of each meshing riser is the "leading sidewall" in the direction of rotation and sidewall 56*a* is the "trailing sidewall". By leading sidewall is meant the well sidewall which first passes under housing cusp 31 in the direction of rotation. Conversely, the pointed edge of lobes 50*a* and 51*a*, defined by trailing sidewall 56*a*, is referred to as the "leading edge" 60*a* and the lobe edge defined by sidewall 55*a* is referred to as the "trailing edge" 61*a*. Thus, as shown, sidewall 55*a* of well 52*a* of riser 17*a* and sidewall 56*a* of well 53*a* of riser 27*a* are immediately opposite each other with risers 17*a* and 27*a* being angularly parallel. In this position the leading edge 60*a* of lobe 50*a* of riser 27*a* is entering well 52*a* of riser 17*a* and trailing edge 61*a* of lobe 51*a* of riser 17*a* is leaving well 53*a* of riser 27*a*. The angular treads 58*b* and 58*c* of risers 17*b* and 27*b* and 17*c* and 27*c*, formed by the angular offset of lobes 50*b*, 50*c* and 51*b* and 51*c*, can also be seen located axially downstream. Treads 58*b* and 58*c* consist of the trailing edge portions of the lobes 50*b*, 50*c* and 51*b* and 51*c* with the leading sidewalls 55*b*, and 55*c*** serving as the tread risers.

FIG. **4*b* shows a cross section of risers 17*b* and 27*b* and the visible portions of angularly offset risers 17*c*, 17*d* and 17*e* and 27*c*, 27*d* and 27*e* with the underlying portion of offset risers 17*c* and 27*c* being shown in dotted lines. As shown, lobe 51*b* of riser 17*b* is engaged in well 53*b* of riser 27*b* and the risers 17*b* and 27*b* are at right angles to each other. Treads 58*c* and 58*d*, formed from lobes 50*c* and 50*d* and 51*c* and 51*d* of offset risers 17*c*, 17*d* and 27*c* and 27*d*** can be seen located axially downstream.

FIG. **4*c* shows a cross section of risers 17*c* and 27*c* and the visible portion of angularly offset risers 17*d*, 17*e* and 17*f* and 27*d*. 27*e* and 27*f* with the underlying portion of offset risers 17*d* and 27*d* being shown in dotted lines. Risers 17*c* and 27*c* are angularly parallel but at right angles to the position shown in FIG. 4*a* with leading edge 60*c* of lobe 51*c* of riser 17*c* entering into well 53*c* of riser 27*c* and trailing edge 61*c* of lobe 51*c* of riser 27*c* leaving well 53*c* of riser 17*c*. Angular treads 58*d* and 58*e* of lobes 50*d*, 50*e* and 51*d* and 51*e* of offset risers 17*d* and 17*e* and 27*d* and 27*e*** can be seen axially downstream.

FIG. **4*d* shows a cross section of risers 17*d* and 27*d* and the visible portion of angularly offset risers 17*e*, 17*f* and 17*g* and 27*e*, 27*f* and 27*g* with the underlying portion of the offset risers 17***f* and 27*f* being shown in dotted lines. In this configuration lobe 51*d* of riser 27*d* is engaged in well 53*d* of riser 17*d* and risers 17*d* and 27*d* are at right angles to each other. Treads 58*e* and 58*f* formed from lobes 50*e*, 50*f*, 51*e* and 51*f* of risers 17*e* and 17*f*, 27*e* and 27*f* can also be seen axially downstream.

It is evident that FIGS. 4*a*, 4*b*, 4*c* and 4*d* differ from each other only in that the position of the risers is 45° removed from one figure to the next in a direction opposite the direction of impeller rotation. This forms the spiraling series of adjacent lobes and wells 52 and 53 as also illustrated in FIG. 1, wherein each well 52 or 53 is in open communication with its immediate axially adjacent well 52 or 53 throughout half the arcuate distance from well sidewall 55 to sidewall 56, the other half of the well being obstructed by angular tread 58 of the next axially adjacent riser.

For proper operation of the invention it is imperative that compressible gases move axially through the compression or expansion stages, to be described in detail, in a sealed environment. It is therefore important that as each lobe traverses through a well that it do so in a manner as to expel axially downstream all gases contained therein and to minimize free expansion losses. In order to do so the configuration of each lobe and well is extremely important as is the angular offset which may vary between maximum and minimum angles to be described.

FIGS. 5*a*–*l* show the manner in which a gas is expelled from a well and how a sealed well volume is created. Reference will be made primarily to the expulsion of gas from one well in each mating riser segment as the expulsion from each other well and the sealing off thereof will be carried out in the same manner.

Figure 4A:
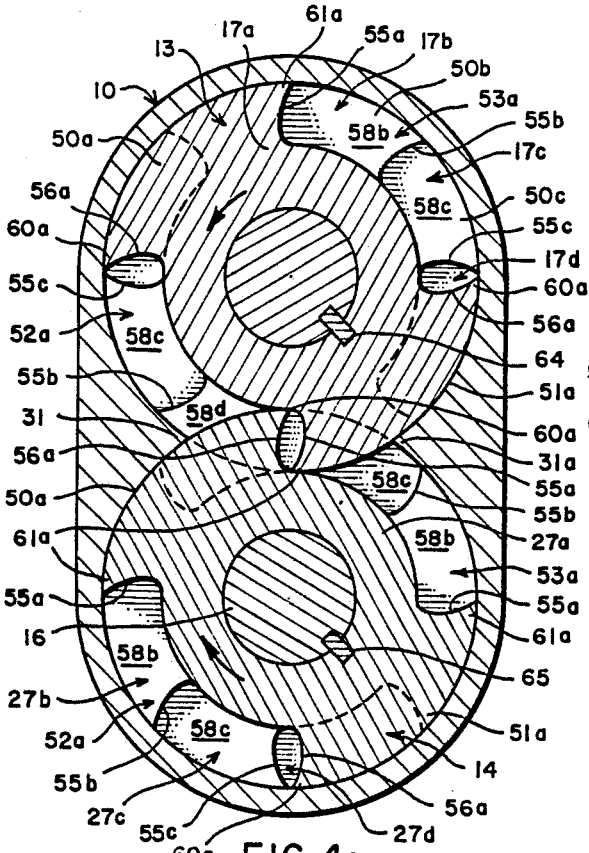
FIGS. 4*a, b, c,* and *d* are transverse cross sectional views taken along lines 4*a*—4*a*, 4*b*—4*b*, 4*c*—4*c* and 4*d*—4*d* of FIG. 2 showing the mating impellers in rotation positions each varying 45° from the preceding one.
Figure 4B:
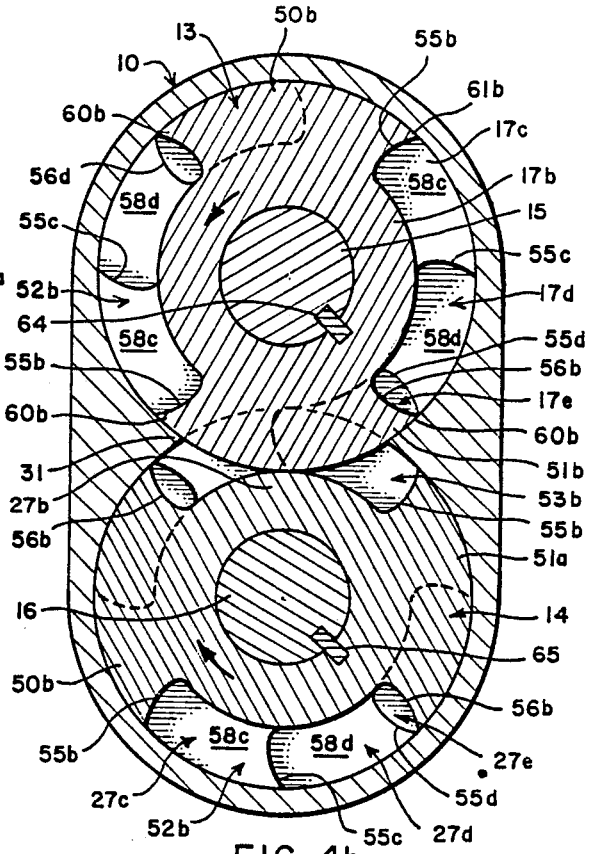
Figure 4C:
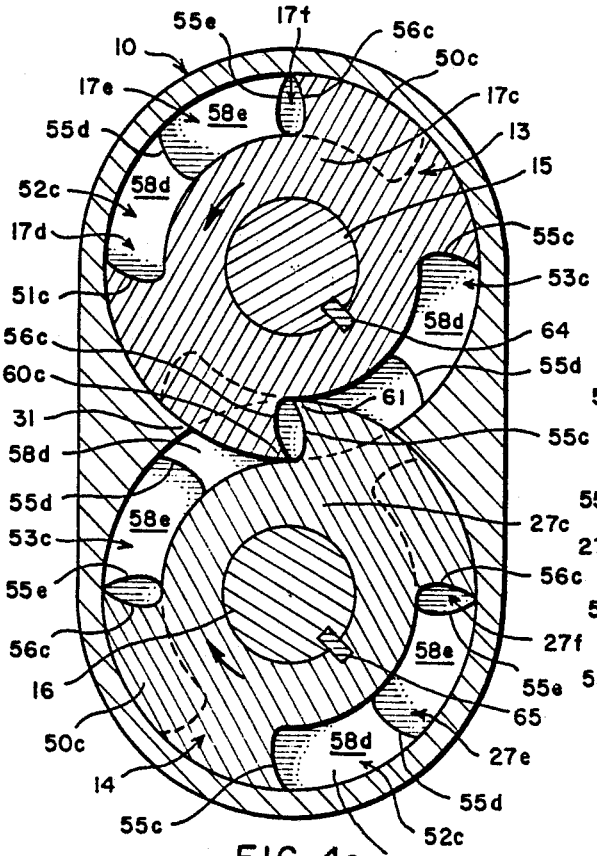
Figure 4D:
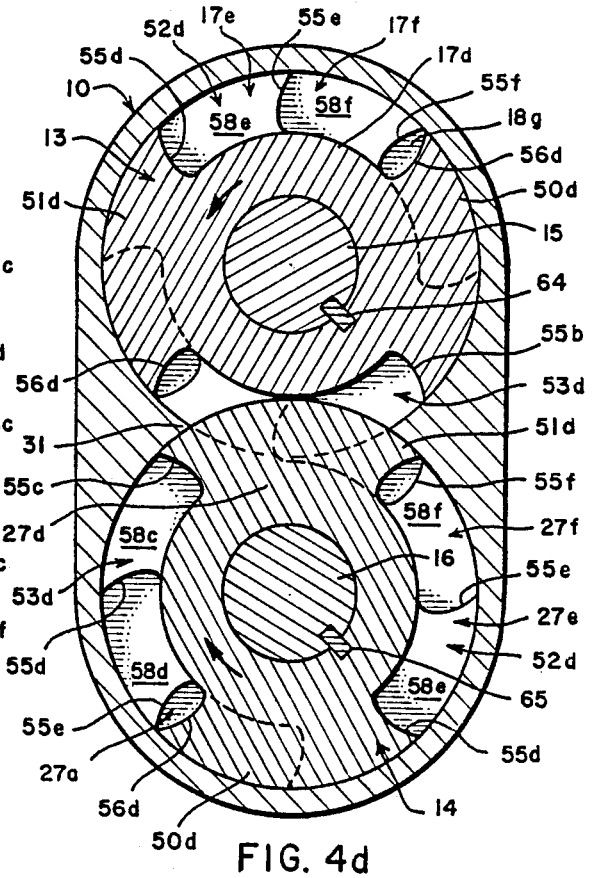
Figure 5A:
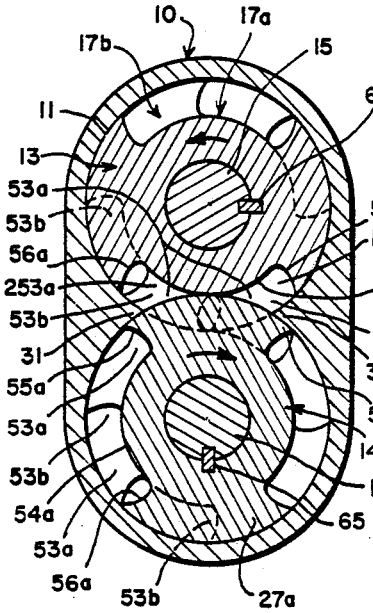
FIGS. 5 *a, b, c, d, e, f, g, h, i, j, k,* and l are transverse cross sectional views similar to FIGS. 4 *a–d* showing the filling, sealing and emptying of well volume as a function of the rotation through a riser well by a mating lobe from a riser of an adjacent impeller.

FIG. 5*a* is a cross section of the internal combustion engine as shown in FIG. 1 with the meshing risers, arbitrarily designated as 17*a* and 27*a*, of impellers 13 and 14 being in the same perpendicular angular positions as shown in FIG. 4*d*, i.e., lobe 51*a* of riser 27*a* is engaged in well 53*a* of riser 17*a* equidistantly between sidewalls 55*a* and 56*a* of that well dividing it into two sections 153*a* and 253*a*. Well 153*a* is sealed from lateral movement by sidewall 55*a* and floor 54*a* in well 53*a* of riser 17*a*, by housing wall 10 defining working chamber 11 and by the outer perimeter of lobe 51*a* of riser 27*a*. Well 253*a* is similarly sealed except trailing sidewall 56*a* is used instead of sidewall 55*a*. Well section 253*a* is in open downstream axial communication with well 53*b* of riser 17*b* Well section 153*a* is sealed from such downstream movement by lobe 50*b* of riser 17*b*. Well 53*a* of riser 27*a* is sealed from transverse flow by sidewalls 55*a* and 56*a* and floor 54*a* thereof and by the housing walls of working chamber 11. Well 53*a* of riser 27*a* is in open communication with well 53*b* of riser 27*b*.

Succeeding FIGS. 5*b*–*l* describe a 170° rotation of each impeller with emphasis being placed on the emptying of well volume 253*a* in riser 17*a* and of the entire well 53*a* of riser 27*a*.

Figure 5B:
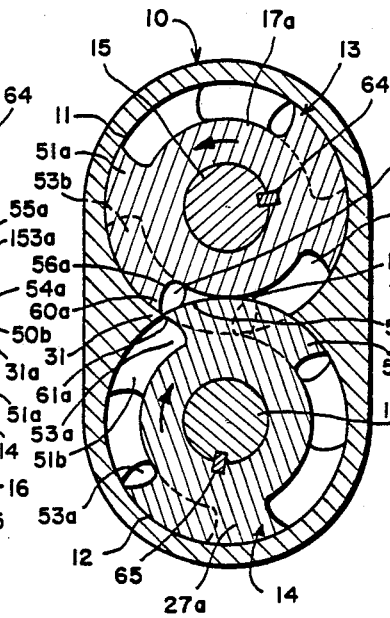

FIG. 5*b* is a cross section rotated 10° from the position shown in FIG. 5*a*. In this position the tip 61*a* of tee trailing edge of lobe 51*a* of riser 27*a* is just touching the tip 60*a* of the leading edge of lobe 51*a* of riser 17*a* at the apex of cusp 31 of housing 10. Lobe 51*a* of riser 27*a* has rotated such that well area 153*a* in riser 17*a* has increased in volume and well area 253*a* has diminished in size while still being in communication with well 53*b* of riser 17*b*. Well volume 153*a* is just opening into downstream axial communication with well volume 153*b* which is in the process of being formed by movement of lobe 51*b* of riser 27*b* in well 53*b* of riser 17*b*. Well 53*a* of riser 27*a* remains as previously described.

Figure 5C:
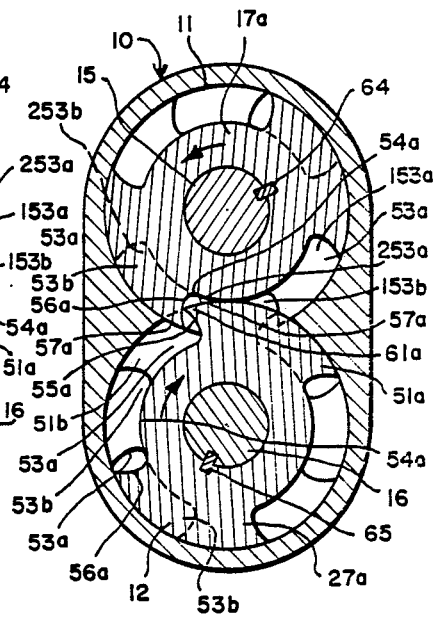

FIG. 5*c* shows the same cross section as in FIG. 5*a* with risers 17*a* and 27*a* being rotated 25° in the direction indicated by the rotational arrows. Trailing edge 61*a* of lobe 51*a* of riser 27*a* has sealingly followed trailing sidewall 56*a* of well 53*a* in riser 17*a* thereby further reducing well volume 253*a* which is now bounded by portions of sidewall 56*a* and floor 54*a* of well 53*a* in riser 17*a* and by the outer perimeter 57*a* of lobe 51*a* of riser 27*a*. Volume 253*a* is still in axial downstream communication with well 53*b* of riser 17*b* ; however, well 53*b* is divided by lobe 51*b* of riser 27*b* into two volumes. Volume 153*b* is expanding in volume and is in communication with volume 153*a* of riser 17*a*. Volume 253*b* is the portion of well 53*b* of riser 17*b* which remains in communication with volume 253*a*. In reference to risers 17*a* and 17*b* it is important to note that as well volume 153*a* grows in area it opens axially downstream into well volume 153*b* which also grows in area as a function of rotation. Upon high speed rotation this forming and expanding of volumes has a spiraling drawing or sucking effect. Conversely, well volumes 253*a* constantly reduces in volume forcing air axially downstream into volume 253*b* which successively reduces in volume and has a blowing or pushing effect. Both effects cause downstream axial movement of air or other compressible gas. Well 53*a* of riser 27*a* is laterally sealed by its sidewalls 55*a* and 56*a* and floor 54*a*, by lobe trailing edge 61*a* of lobe 51*a* of riser 27*a*, by housing walls of working chamber 12 and by sidewall 56*a* of well 53*a* of riser 17*a* and outer lobe perimeter 7*a* of lobe 51*a* of riser 17*a*. Lobe 51*a* of riser 17*a*, starting to protrude into well 53*a* of riser 27*a*, begins to reduce the well volume and starts the axial air flow from well 53*a* of riser 27*a* to well 53*b* of riser 27*b*.

Figure 5D:
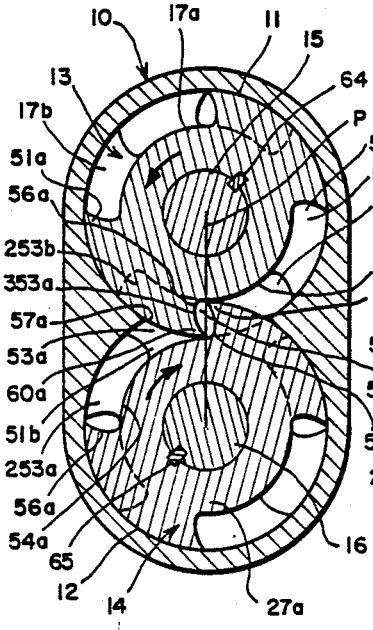

The point at which a well volume is sealed from upstream axial movement is illustrated in FIG. 5*d* which is a cross section of risers rotated 45° from the position shown in FIG. 5*a*. In this illustration well volume 253*a* in riser 17*a* is not shown since it has completely disappeared by the revolution of lobe 51*a* of riser 27*a* to the point indicated. Well volume 253*b* in riser 17*b* is blocked from backward or upstream axial movement by lobe 51*a* of riser 17*a* thereby forming a spiraling axial volume of communicating wells sealed from backward axial movement. Well volume 153*a*, as distinguished from entire well volume 53*a* of riser 17*a*, has reached its maximum volume at this point. Well volume 153*a* remains in communication with well volume 153*b* of riser 17*b*.

From the preceding figures it is evident that trailing edge 61*a* of lobe 51*a* of riser 27*a* has sealingly followed the surface of trailing sidewall 56*a* of well 53*a* of riser 17*a* from its outer perimeter, as shown in FIG. 5*b*, to the juncture of sidewall 56*a* and floor 54*a*, as shown in FIG. 5*d*. In this position leading edge 60*a* of lobe 51*a* of riser 17*a* sealingly engages the intersection of sidewall 55*a* and floor 54*a* of well 53*a* of riser 27*a* and lobe trailing edge 61*a* of lobe 51*a* of riser 27*a* sealingly engages the intersection of sidewall 56*a* and floors 54*a* of well 53*a* in riser 17*a* creating an enclosed well volume 353*a* contained by opposing leading sidewall 55*a* of well 53*a* of riser 27*a* and trailing sidewall 56*a* of well 53*a* of riser 17*a*. The air or other compressible gas, contained in well volume 353*a* is subject to free expansion and resultant energy loss and should therefore be minimized as much as possible. However, volume 353a is dictated by the curvature required for the sidewalls. The only way to minimize volume 353a and hence lower free energy loss is to lessen the depth of a well and have the inner radius "$r_i$" approach the outer radius "r". As $r_i$ increases, the length of sidewalls 55a and 56a decrease. The well depth, i.e., $r-r_i$, will obviously be dictated by practical application as some free energy loss must be tolerated. In the position indicated in FIG. 5d, risers 17a and 27a are angularly parallel and a straight line P intersecting their respective axes also intersects well volume 353a such that leading edge 60a of lobe 51a of riser 17a and trailing edge 61a of lobe 51a of riser 27a also lie on that line. It is evident from FIGS. 5b, *c* and *d* that as trailing edge 61a of lobe 51a of riser 27a has followed along sidewall 56a of well 53a of riser 17a the trailing edge has sealed well volume 253a in riser 17a from communication with well 53a in riser 27a and caused the reduction and elimination of well volume 253a in riser 17a.

Figure 6:
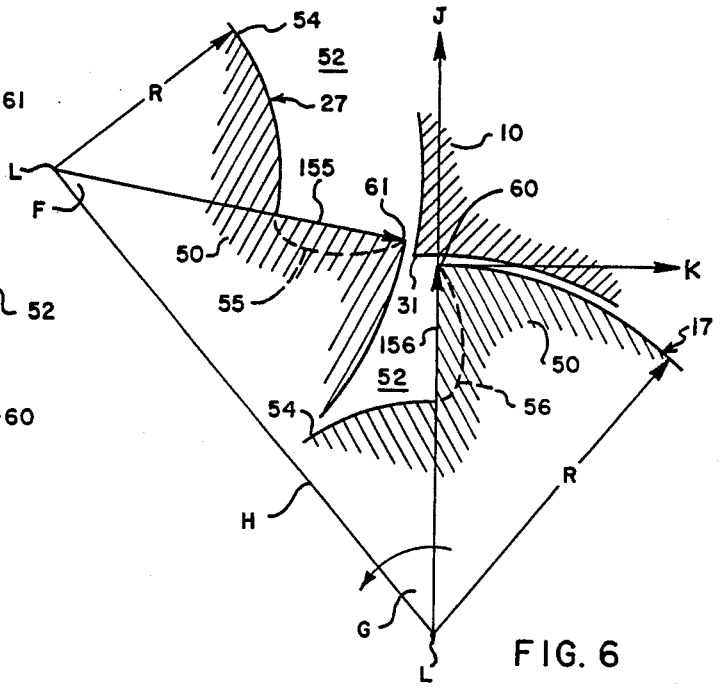
FIG. 6 is a partial transverse cross sectional schematic view of two theoretical risers having straight sidewalls about to intermesh and of the housing cusp at the point the working chambers intersect.

The means for determining the curvature of the well sidewalls 55a and 56a to obtain the constant sealing relationship between wells of intermeshing risers is taught in conjunction with FIG. 6 and the description thereof.

In forming well volume 353a between the lobes of the respective risers as shown in FIG. 5d it may be seen that lobe 51a of riser 17a has further penetrated into well 53a of riser 27a and has sealed well 53a into volume 353a and 253a in riser 27a. Volume 253a is bounded by housing wall of working chamber 12, by the outer perimeter 57a of lobe 51a of riser 17a and by sidewall 56a and floor 54a of well 53a in riser 27a.

As noted in FIG. 5d lobe 51b of riser 27b is immediately downstream of well volume 353a preventing downstream axial movement of gases in this well volume. However, upon continued rotation of risers 17a and 27a, volume 353a opens and literally communicates with well 53a of riser 17a.

Figure 5E:
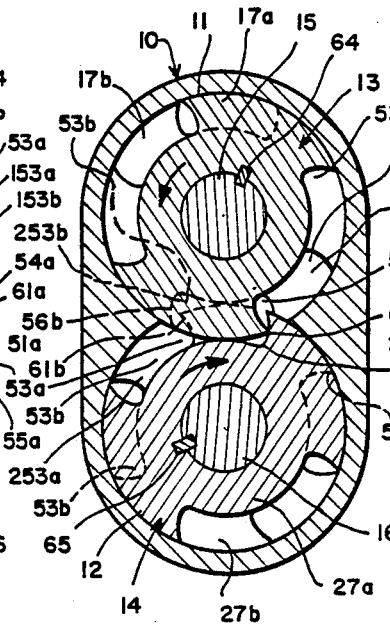

Focus, will now be placed on the emptying of well volume 253a of riser 27a. *FIG. 5e* shows a cross section of risers 17a and 27a rotated 65° from the initial position of FIG. 5a. In this position well volume 353a and well volume 153a in riser 17a, as shown in FIG. 5d, have opened into a single volume in well 53a of riser 17a with the resulting equalization of pressure of gases which were contained in those two volumes. Well 53a of riser 27a has now been divided into two well volumes 153a and 253a by lobe 51a of riser 17a. Well volume 153a of riser 27a is sealed from communication with well 53a of riser 17a by leading edge 60a of lobe 51a of riser 17a. Well volume 153a is in its formative stage in riser 27a and is blocked from downstream axial movement by lobe 51b of riser 27b. Conversely, well volume 253b in riser 17b has become still smaller by the continued rotation of lobe 51b of riser 27b through well 53b of riser 17b. Note that trailing edge 61b of lobe 51b of riser 27b is sealing sidewall 56b of riser 17b preventing communication between well volume 253b of riser 17b and well volume 53b of riser 27b. Thus, as well volume 253b of riser 17b decreases in volume, gases contained therein are forced axially downstream since they are sealed from upstream movement by lobe 51a of riser 17a as previously described. It should also be noted that well volumes 53a and 153b in risers 17a and 17b respectively have continued to grow in volume area from that shown in FIG. 5d. Well volume 253a of riser 27a is in open communication with well volume 53b of riser 27b.

Figure 5F:
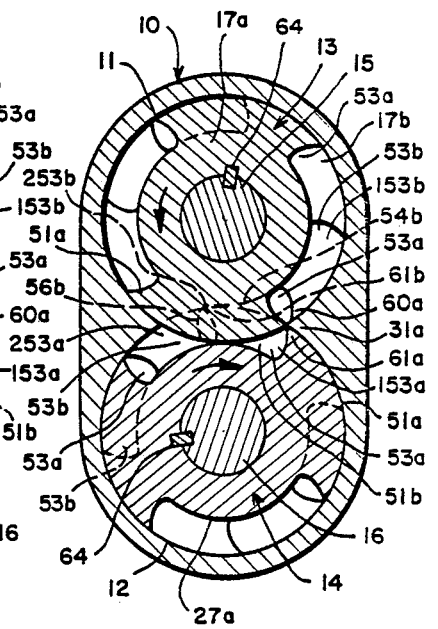

The continued rotation shown in FIG. 5f is through 80° from the position shown in FIG. 5a. In this position the leading edge 60a of lobe 51a of riser 17a meets the trailing edge 61a of lobe 51a of riser 27a at the cusp 31 on the trailing side of housing 10. Lobe 51a of riser 17a has attained maximum volume penetration into well 53a of riser 27a. Well 53a of riser 17a and well volume 153b of riser 17b remain in open communication. Volume 253b of riser 17b nears elimination as trailing edge 61b of lobe 51b of riser 27b approaches the junction of sidewall 56b and floor 54b of well 53b in riser 17b. Well volume 153a of riser 27a continues to increase in size but is still blocked from downstream axial flow by lobe 51b of riser 27b. Well volume 253a of riser 27a has diminished in volume and remains in open downstream axial communication with well 53b of riser 27b.

Figure 5G:
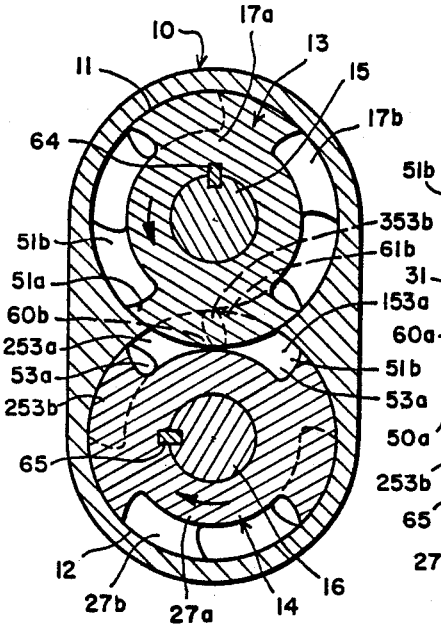

FIG. 5g completes a 90° rotation of risers 17a and 27a from the position shown in FIG. 5a. Well 53a of riser 27a is now divided into two equal sections, increasing well volume 153a and increasing well volume 253a by lobe 51a of riser 17a. Risers 17b and 27b are angularly parallel and their respective lobes 51b of each are aligned such that trailing edge 61b of lobe 51b of riser 27b and leading edge 60b of lobe 51b of riser 17b lie on a straight line intersecting the axes of the two risers thereby forming well volume 353b from wells 53b in each riser. Well volume 253b in riser 27b is at its maximum volume and is in axial communication with well volume 253a of riser 27a which continues the emptying process. In addition, well volume 253b will be in axial communications with well volume 53c(not shown). Well volume 153a of riser 27a has grown in size but continues to be blocked from axial downstream flow by lobe 51b of riser 27b.

Volumes 153a and 253a of riser 27a are now the same as volumes 153a and 253a were in riser 17a as described in FIG. 5a and the process of emptying volume 253a and the expanding volume of 153a will be the same as previously described. Hence the descriptions of the remaining FIGS. 5h–l will be abbreviated with cross reference to similar situations in preceding FIGS. 5a–g.

Figure 5H:
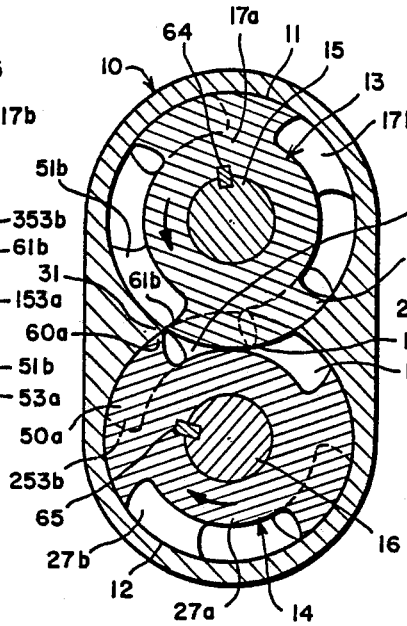

FIG. 5h is a cross section rotated 100° from FIG. 5a and 90° from FIG. 5b. In this position the leading edge 60a of lobe 50a of riser 27a meets the trailing edge 61a of lobe 51a of riser 17a at the housing cusp 31 on the leading side of the housing. Well volume 253a of riser 27a continues to diminish in size and is in communication with well volume 253b of riser 27b. Well 53b of riser 27b, previously shown in FIG. 5g as being divided into well volumes 253b and 353b, has now been divided into two volumes 253b and 153b by lobe 51b of riser 17b. Well volume 153a of riser 27a is now in communication with opening well volume 153b of riser 27b which is sealed from further downsteam axial communication by lobe 51c of riser 27c (not shown).

Figure 5I:
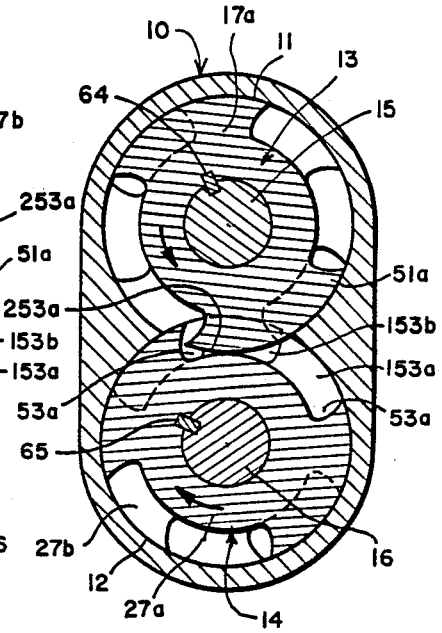

FIG. 5i shows a 115° rotation from the position of FIG. 5a and is 90° from FIG. 5c. Therefore, the description of FIG. 5c is pertinent. Well volume 253a of riser 27a has all but been eliminated by the rotation of lobe 51a of riser 17a through well 53a of riser 27a and remains in axial downstream communication with well volume 253b in riser 27b. Well volume 153b in riser 27b continues to provide axial downstream communication for well volume 153a of riser 27a.

The stepwise emptying of well volume 253a in riser 27a has been shown in FIGS. 5d–i. In each successive step volume 253a has been reduced in size but has always been in axial downstream communication with well 53b, or well volume 253b when well 53b has been divided into two volumes, of riser 27b.

Figure 5J:
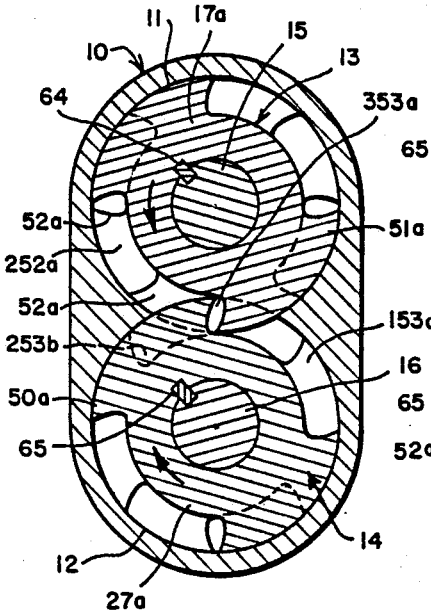

The sealing off of well volume 253a in riser 27a from upstream axial movement has been completed by the configuration shown in FIG. 5j which is a cross section of risers rotated 135° from FIG. 5a and is 90° different from FIG. 5d. This illustrates the position of risers 17a and 27a shown in FIG. 1. Well volume 253a shown in FIG. 5i no longer exists and well volume 253b in riser 27b is blocked from upstream axial movement by lobe 50a of riser 27a. Well volume 353a has been formed by the entrance of lobe 50a of riser 27a into well 52a of riser 17a and the consequent rotation of lobe 51a of riser 17a to the positions previously described where the trailing edge of one lobe, the leading edge of the facing lobe and the axes of the two risers all lie on a straight line. Well 52a of riser 17a is thus being divided with the formation of well volume 252a. It is evident that, upon subsequent rotation this well volume will be emptying. It should be equally evident from the above discussion that a sealed well volume is created by every 90° rotation of risers throughout the impellers. The sealed volumes are created alternately. For example, in the description of FIGS. 5a–5d it was volume 253a in riser 17a that eventually was sealed off. In FIGS. 5e–5j it was volume 253a of riser 27a that eventually was sealed. Obviously, the sealing of a well volume from upstream axial movement also provides the sealing of a forming well volume from downstream axial movement. Thus, there is a 360° sealed helical stepped volume or of a compressible gas which moves axially along the impellers as a function of the rotation thereof.

Figure 8A:
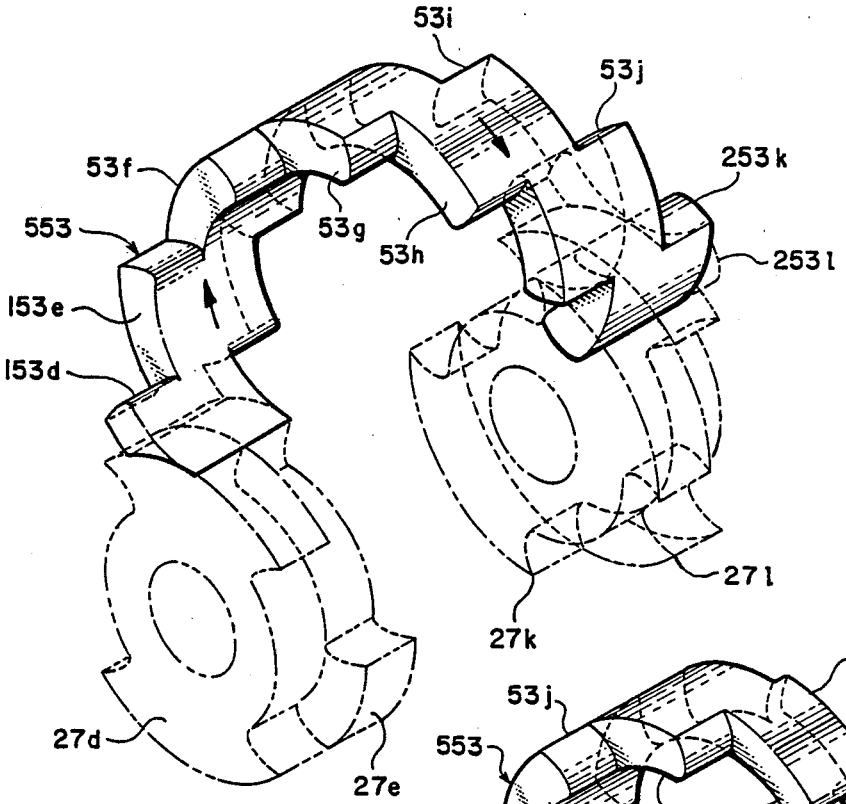
FIGS. 8*a, b* and *c* are pictorial views of a stepped helical sealed volume of air as it progresses axially through the compressor function of the device of FIG. 1.
Figure 8B:
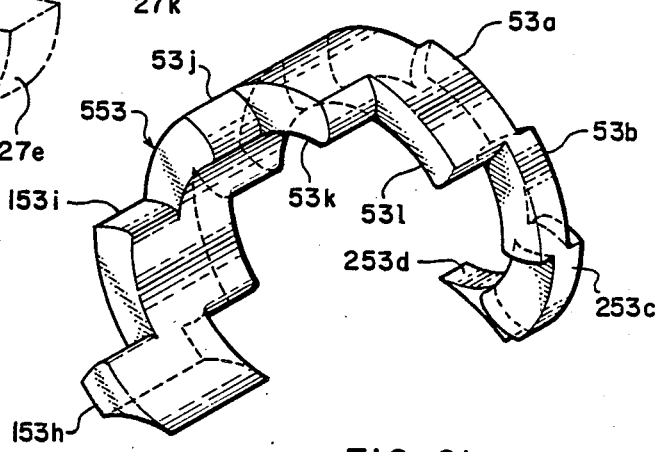
Figure 8C:
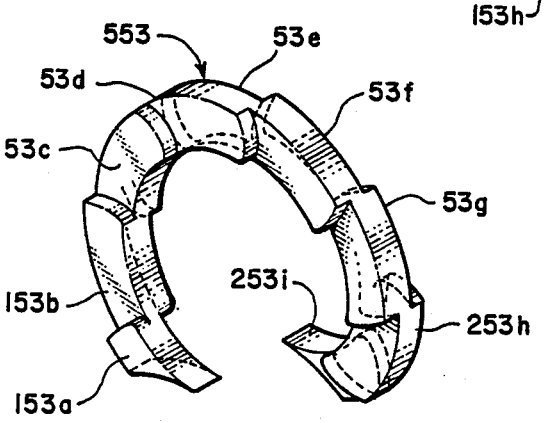

These sealed volumes can best be seen with reference to FIGS. 1 and 8a, *b* and *c*. In FIG. 1 with a spiraling series of wells formed from axially adjacent risers along the length of impellers 13 and 14 may be visualized. A sealed volume of air, or other compressible gas, will have the same shape or configuration as the spiraling series of wells. These sealed volumes are arbitrarily designated by the numeral 553 in FIGS. 8a, *b* and *c* since wells 53 have been the wells primarily used for sealing purposes in this detailed description. These figures will be described in detail later when referring to the operation of the invention. It is sufficient to state that FIG. 8a shows a sealed maximum area volume of compressible gas 553 in an uncompressed or expanded state formed in the wells of impeller 13. A sealed volume formed in impeller 14 would have the same configuration but would be helically stepped in the opposite direction. FIG. 8b shows the same mass amount of gas 553 in a partially compressed state and having a reduced volume and FIG. 8c shows the same mass amount of gas 553 in a fully compressed state having a minimum volume size.

Figure 5K:
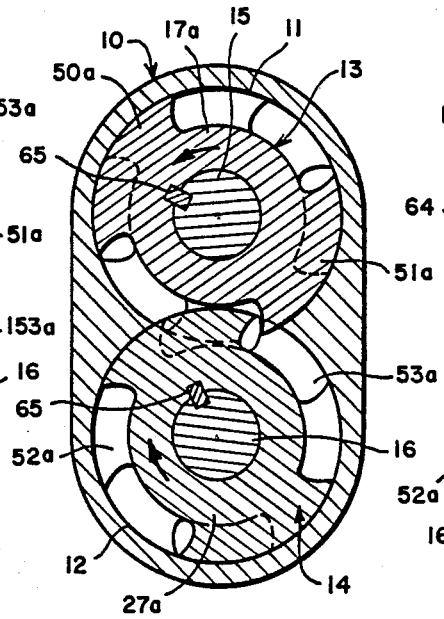
Figure 5L:
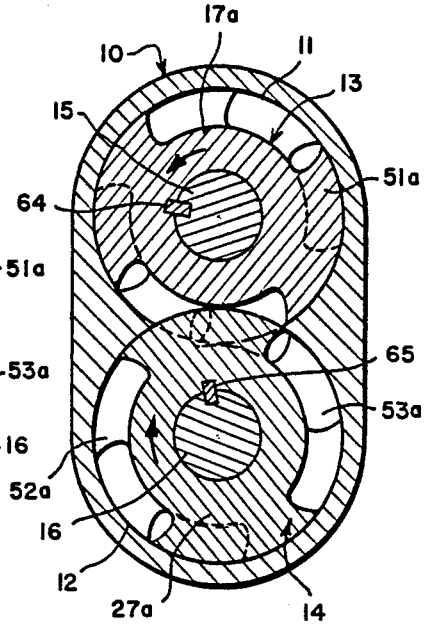

FIGS. 5k and 5l show the continued rotation of risers 17a and 27a through 155° and 170° respectively from the position shown in FIG. 5a and are included only to show the completion of a rotative cycle wherein lobe 51a of riser 17a have completely traversed well 53a of riser 27a.

In summary, from viewing each of the various views of FIGS. 5b through 5l one can see that leading edge 60a, outer perimeter 57a and trailing edge 61a of lobe 51a of riser 17a have followed, in a sealing relationship, sidewall 55a, floor 54a and sidewall 56a of well 53a in riser 27a. This traversal of lobe 51a of riser 17d through well 53a of riser 27a has accounted for the dividing of the well into different well volumes, the first being volumes 253a and 353a as shown in FIG. 5d. Well volume 353a does not pass axially downstream but empties into well 53a of riser 17a thus becoming united with well volume 153a of riser 17a. Well volume 153a of riser 27a is always an expanding volume. Conversely, well volume 253a of riser 27a is a decreasing volume. It may be seen that as well volume 253a of well 53a in riser 27a is sealed from upstream axial movement, well volume 153a of well 53a in riser 27a expands to occupy the complete well volume of 53a which well, upon its next meshing with lobe 51a of riser 17a, will again be divided and purged in the described manner. While the above description has been made with reference to lobes 51a and wells 53a the same reasoning holds true for lobes 50a meshing with wells 52a with the creation of divided well volumes which would be numbered 152a, 252a and 352a respectively.

In order for leading edge 60 of any lobe to sealingly mate with the leading sidewall 55 of any given well and for the trailing edge 61 of any given lobe to sealingly mate with the trailing sidewall 56 of any given well it is essential that precise machining of sidewalls 55 and 56 be done to obtain the correct curvature line and, conversely, lobe shape in any given riser. FIG. 6 is a partial cross sectional view of two schematic intermeshing risers 17 and 27 and housing 10 at cusp 31. The sidewalls 155 and 156 are shown as being straight and lying along a radial line extending from the axis L of each riser to the outer circumference of lobes 50. Riser 17 rotates counterclockwise and riser 27 rotates clockwise. Upon rotation of risers 17 and 27 equal angles F and G will diminish with trailing edge 61 of lobe 50 in riser 27 meeting leading edge 60 of riser 17 at cusp 31 and trailing edge 61 cutting arcuately into sidewall 156 in riser 17 as indicated by dotted sidewall line 56 as equal angles F and G diminish to zero along line H. At this point leading edge 60 on lobe 50 of riser 17 will have just reached floor 54 in well 52 of riser 27 and trailing edge 61 on lobe 50 of riser 27 will have completed its cutting action through sidewall 156 along dotted line 56 and also just have reached floor 54 of well 52 in riser 17. Trailing edge 61 will have traversed the same path along the forming sidewall of dotted line 56 as described in FIGS. 5b, *c* and *d* and risers 17 and 27 will be in the same position as risers 17a and 27a in FIG. 5d. Upon continued rotation the leading edge 60 on lobe 50 of riser 17 will cut an arcuate path along dotted line 55 out of sidewall 155 as equal angles F and G increase until edges 60 and 61 meet at cusp 31a (not shown) on the trailing side of the housing. The equation to follow for cutting sidewall 155 to its proper curvature is given as follows where the cartesian coordinate system defined at point I has lines J and K as the positive x and y coordinate axes respectively. The equation for the sidewall is then given by:

$$x = r \times \sin(2\theta) - (r_i + r) \times \sin\theta$$

$$y = (r_i + r) \times \cos\theta - r \times [1 + \cos(2\theta)]$$

where $r_i$ = inner radius r = outer radius, and $0 \leqq \theta \leqq \theta$ max where $$\theta\max = \frac{\cos r_i/r + 1}{2}$$

The arcuate cutting of sidewall 156 may similarly be determined.

Regardless of the depth of the well, i.e., outer radius "r" minus inner radius "$r_i$", or how many lobes and wells a riser may have there is a minimum and maximum angular offset which may occur between adjacent risers on an impeller. The minimum offset angle "M" is a function of well depth, i.e., $r-r_i$. The maximum angle "M'" is determined by the number of wells and lobes in a riser. In either event, the offset is determined primarily by the point at which undesirable communications between well volumes would take place.

Figure 7A:
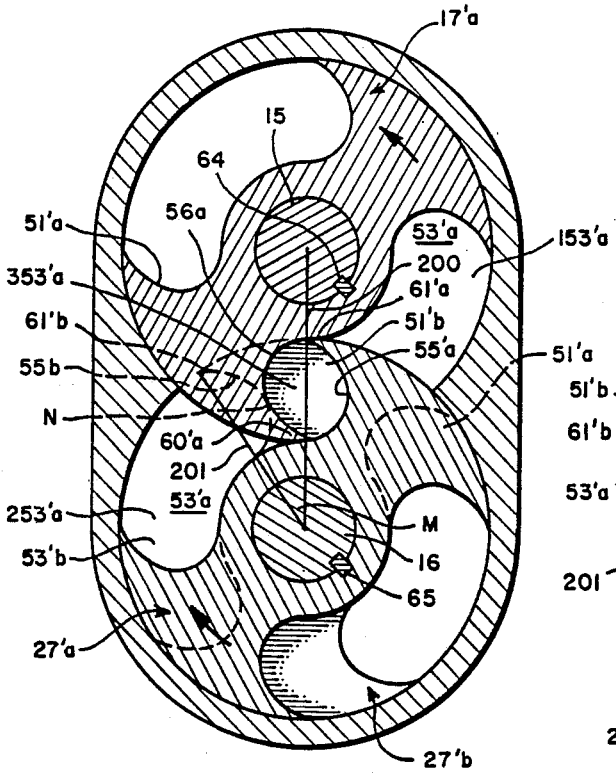
FIGS. 7*a* and 7*b* are cross sectional views similar to those shown in FIGS. 4 and 5 illustrating how minimum and maximum offset angles between adjacent axial risers on an impeller are determined.

FIG. 7*a* shows how the minimum offset angle "M" between L axially offset risers 27'*a* and 27'*b* may be determined. The depth of the wells in these risers has been enlarged to better show the minimum angle. Risers 17'*a* and 27'*a* are positioned as in FIG. 5*d* and are angularly parallel with leading edge 60'*a* of lobe 51'*a* of riser 17'*a* and trailing edge 61'*a* of lobe 51'*a* of riser 27'*a* lying on a straight line 200 intersecting the axes of both risers. Opposing sidewalls 56'*a* of well 53'*a* of riser 17'*a* and 55'*a* of well 53'*a* of riser 27'*a* define the boundaries of sealed well volume 353'*a*. Well 53'*a* of riser 17'*a* is thus divided into well volumes 353'*a* and 153'*a* and well 53'*a* of riser 27'*a* is divided into well volumes 353'*a* and 253'*a* as shown. Upon rotation of the risers, volume 353'*a* will open into volume 153'*a* in riser 17'*a*. Riser 27'*b*, positioned axially downstream, blocks the axial flow of air from well volume 353'*a*. To prevent axial downstream leakage, trailing sidewall 56'*a* of well 53'*a* in riser 17'*a* and leading sidewall 55'*b* in well 53'*b* of riser 27'*b* may meet but not overlap at point N. If there were overlap of these sidewalls at this point, air in volume 353'*a* would be in communication with well volume 53'*b* in riser 27'*b* and also with well volume 253'*a* in riser 27'*a* and would not be sealed. In addition, upon a slight degree of rotation, well volume 353'*a* would open into well volume 153'*a* in riser 17'*a*. If the offset angle were less than the minimum, air in well volume 153'*a* of riser 17'*a* could also be in communication with air in well volume 53'*b* in riser 27'*b* which in turn communicates with well volume 253'*a* in riser 27'*a* and there still would be no sealing. Therefore, the minimum angle M is determined by the tip of trailing edge 61'*a* of lobe 51'*a* of riser 27'*a* being on line 200 which line intersects the axes of riser 17'*a* and 27'*a* and placing riser 27'*b* such that the leading sidewall 55'*b* of well 53'*b* of riser 27'*b* and the trailing sidewall 56'*a* of well 53'*a* of riser 17'*a* meet but do not overlap at point N. The minimum angle M is then determined by drawing line 201 from the axis of risers 27'*a* and 27'*b* to trailing edge 61'*b* of lobe 51'*b* of riser 27'*b*. The angle "M" between lines 200 and 201 is then the miniumum angle. Obviously this angle will decrease as inner radius "$r_i$" approaches outer radius "r".

Figure 7B:
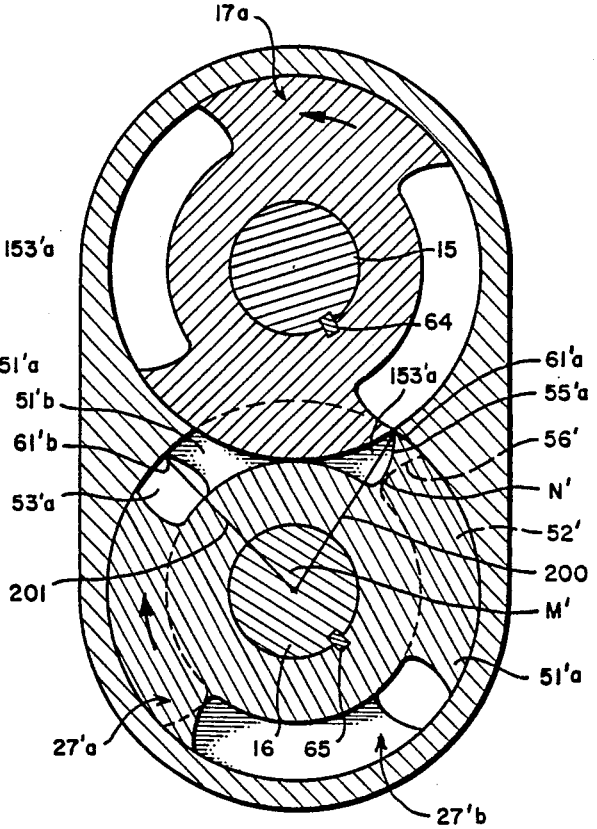

The maximum angle "M'" is determined as shown in FIG. 7*b* which shows risers 17'*a* and 27'*a* in the same positions as in FIG. 5*f*. The maximum angle is determined by placing riser 27'*b* such that there can be no communication between well volume 153'*a* of riser 27'*a* and well 52'*b* of riser 27*b*. In other words, the trailing portion of lobe 51'*a* of riser 27'*a* and the leading portion of lobe 51'*b* of riser 27'*b* must meet or overlap sufficiently at point N' that leading sidewall 55'*a* of well 53'*a* of riser 27'*a* and trailing sidewall 56'*b* of well 52'*b* of riser 27'*b* do not overlap at point N'. With sidewalls 55'*a* and 56'*b* of adjacent risers being placed as indicated at point N'the maximum angle "M'" is the angle between a line 200' extending from the axis of risers 27'*a* and 27'*b* to trailing edge 61'*a* of lobe 51'*a* of riser 27'*a* and a line 201' extending from the same axis to the trailing edge 61'*b* of lobe 51'*b* of riser 27'*b*. It is apparent that if the numbers or wells and lobes in a riser are increased the angle M' would decrease. However, the method of determining the maximum angle would remain the same.

The angular offset between axially adjacent risers may vary as may the numbers of lobes and wells in adjacent risers. The requirements that must be met at all times is that the risers in adjacent impellers must intermesh, and the lobes of a riser in one impeller must sealingly engage the wells of the riser in the impeller with which it intermeshes. Also, there must be a sealed stepped helical axial downstream gas flow along the wells of the intermeshing impellers. With the above description one skilled in the art could put together many variations of impellers within the scope of the invention. Certain variations in construction of lobes and impellers will be described in conjunction with FIGS. 13–18.

Figure 2:
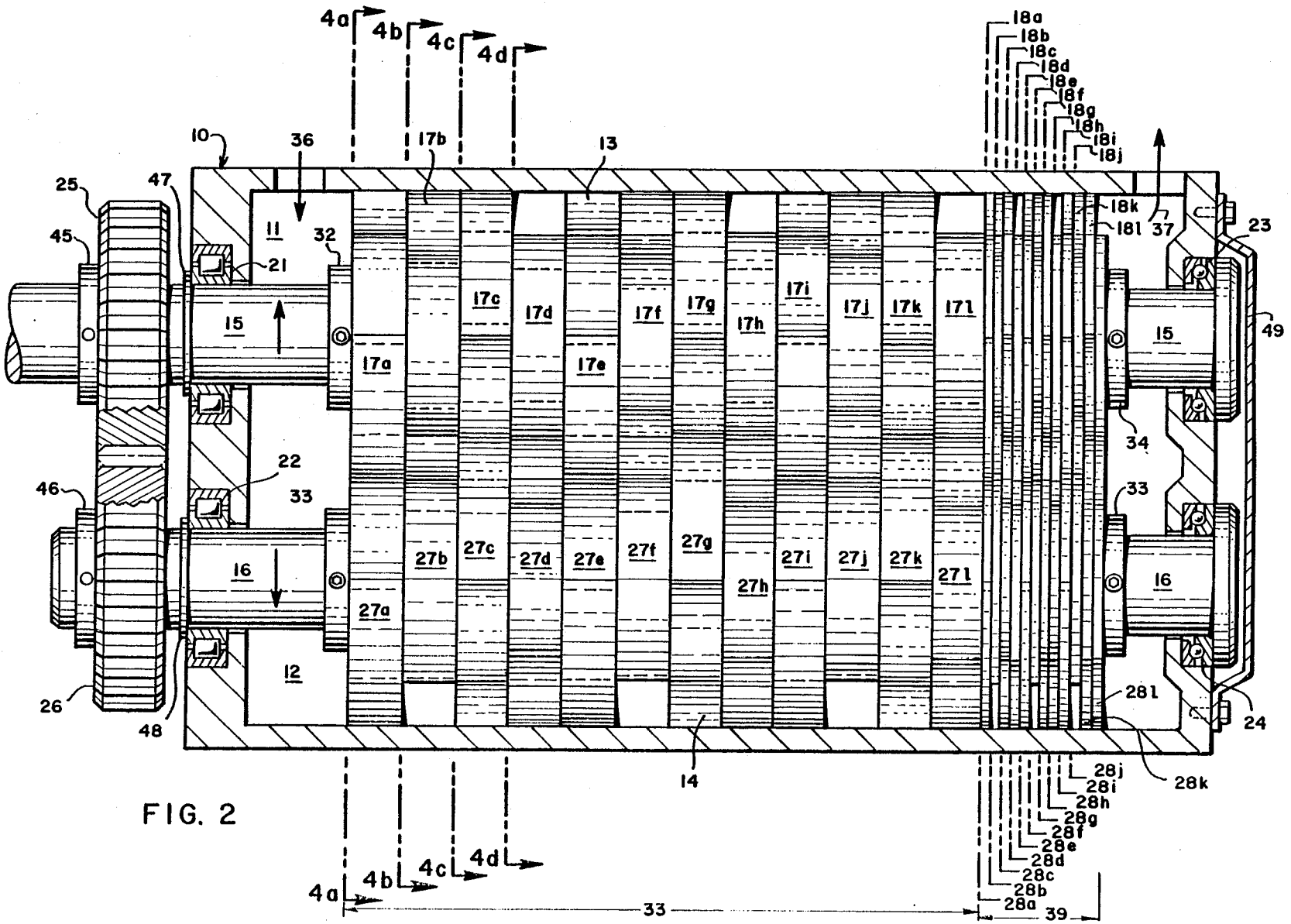
FIG. 2 is a longitudinal side view of the embodiment as shown in FIG. 1, with the casing shown in cross section with casing ends in place and with the impellers shown as being divided into separate riser sections.
Figure 9:
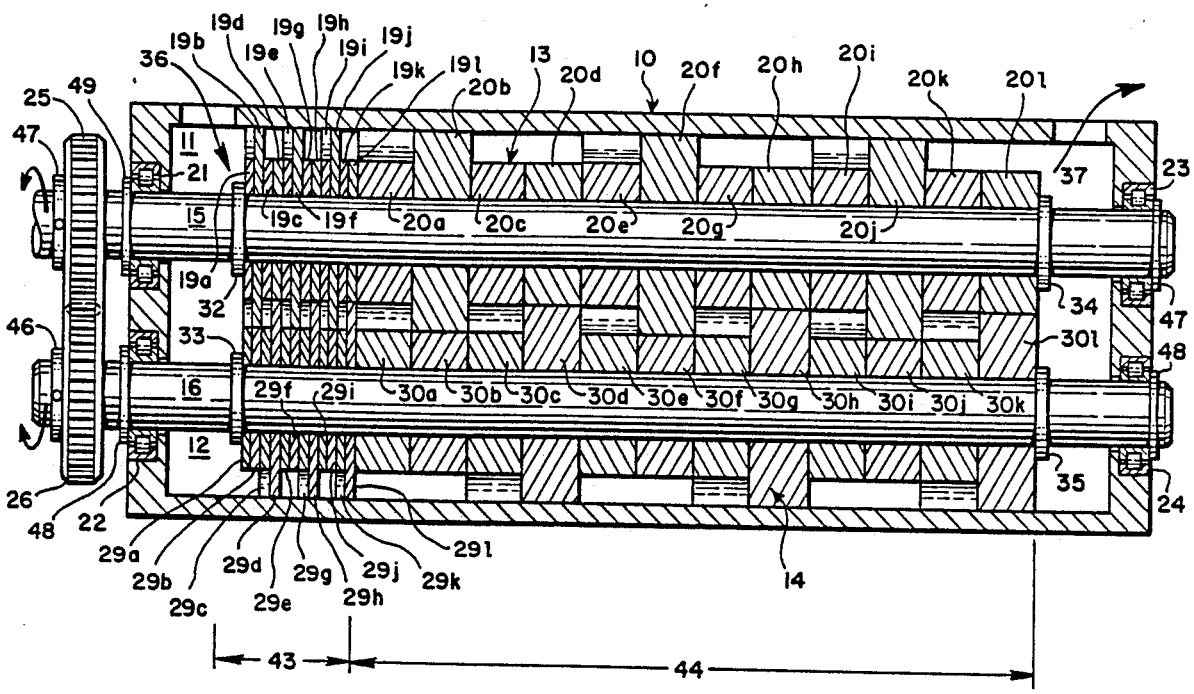
FIG. 9 is a longitudinal cross sectional view of an embodiment of an expansible chamber device similar to that of FIG. 1 showing a fluid motor or expansion function.

The arrangement of the impellers as described is the same for each riser set shown in FIG. 2 functioning as a compressor and in FIG. 9 functioning as a fluid motor or expander. In FIG. 2 intake risers 17*a–l* mate with intake risers 27*a–l* in the intake section 38 of the compressor and compression risers 18*a–l* mate with compression risers 28*a–l* in compression section 39. Reference numerals in FIG. 9 are the same as in FIG. 2 except for riser series 19, 20, 29 and 30. In FIG. 9, expansion intake risers 19*a–l*, located on shaft 13, mate with risers 29*a–l* located on shaft 14, in expansion intake section 43 and expansion risers 20*a–l* on shaft 13 mate with risers 30*a–l* on shaft 14 in expansion section 44. With reference to FIG. 2, the only difference between risers in intake section 38 and compression section 39 is in the height of the risers. Similarly, with reference to FIG. 9, the only difference between the risers in the expansion intake section 43 and the expansion section 44 is in the riser height. This difference, relative to the direction of compressible gas flow, determines whether the successive riser stages will function as a compressor or expander of compressible gases. However, to discuss the make up of each riser stage in the same detail as used to describe the risers in series 17 and 27 would serve no useful purpose and will be readily discernible to one skilled in the art. Thus, in each compressor or expander function, the initial series of risers is an intake series and is followed by a differential series which may be either a compressor or expansion series depending upon the height of the risers in the differential series. If the riser height is smaller in the differential series it will be a compression series and if it is larger it will be an expansion series.

The impellers as shown in FIGS. 1, 2 and 9 are designed to operate at relatively high rpm's. Timing gears 25 and 26 may be provided on shafts 15 and 16 to insure proper timed rotation of the impellers with a minimum controlled clearance between the meshing lobes and wells of the risers. Morever, since power supplied to the impellers in a compressor function as shown in FIG. 2 or taken from the impellers operating as a fluid motor as shown in FIG. 9 is usually carried by a single shaft, there must be a transfer of power from one impeller to another with which it is mating. Therefore, gears 25 and 26 serve to distribute power input from one shaft to both impellers or to combine power output from both impellers to a single shaft. Gears 25 and 26 are secured to shafts 15 and 16 from axial movement by collars 45 and 46.

The functioning of the invention as a compressor and as a fluid motor will now be described.

In the embodiment as shown in FIGS. 1, 2 and 9 with the impellers 13 and 14 intermeshed with each other and disposed in working chambers 11 and 12 of housing 10 a compressible gas cannot flow directly from the inlet 36 past intake and compression sections 38 and 39 of FIG. 2 or through expansion intake and expansion sections 43 and 44 and out the outlet 37 of FIG. 9.

As evident from FIGS. 1–9 each impeller contains two stepped spirals of wells 52 and 53 continuously extending along the lengths of contiguous riser sections, i.e, from riser 17*a* through 18*l* and from riser 27*a* through 28*l* in the compressor comprising sections 38 and 39 shown in FIG. 2 and from riser 19*a* through 20*l* and from riser 29*a* through 30*l* in the expander comprising sections 43 and 44 shown in FIG. 9. A compressible gas from inlet 36 entering wells 52*a* and 53*a* in risers 17*a* and 27*a* in compressor intake section 38 of FIG. 2 or entering wells 52*a* and 53*a* in risers 19*a* and 29*a* in expansion intake section 43 of FIG. 9 passes axially downstream from well to well in the manner shown in FIGS. 5*a–l* and the preceding description. The gases are forced to flow axially downstream as already described and each spiraling series of wells 52 or 53 along each impeller is soon sealed from backward or upstream movement by the rotation of the impellers and intermeshing of the lobes and wells. With reference to FIGS. 1 and 2 the compressible gas passes from riser to riser along intake section 38. Since the riser heights along intake risers 17*a–l* and 27*a–l* in this section are the same there would be no appreciable compression of a sealed gas volume located entirely within this section. For the same reason, there would be no appreciable compression of a sealed gas volume located entirely within risers 18*a–l* and risers 28*a–l* in compression section 39 as a compressible gas passes from riser to riser in that section. For compression to occur there must be a sealed volume of a compressible gas which involves risers in both sections 38 and 39 and that sealed volume must move axially downstream with an accompanying decrease in sealed volume size as a function of impeller rotation. In some instances, depending upon the number of risers in each section and the angular rotation of adjacent risers, a sealed volume may not be formed within the risers of section 38 or section 39 alone. However, a sealed volume involving risers in both sections 38 and 39 is still subject to compression as will be explained in connection with FIG. 8*b*. For purposes of illustration it will be assumed that a complete sealed volume is formed within intake risers 17*a–l* and 27*a–l* in intake section 38. In that situation, once the sealed volume of compressible gas in wells 52*l* and 53*l* in risers 17*l* and 27*l* passes into communicating wells 52*a* and 53*a* in compression risers 18*a* and 28*a* of compression section 39 the compression of that sealed volume will have commenced due to the difference in riser height in risers in section 39 from the riser height of risers in section 38.

For explanation purposes let it be assumed that air contained in wells 52 and 53 of risers 17*d–l* and 27*d–l* in section 38 is sealed from axial upstream or downstream movement, i.e., forms sealed volumes as shown in FIG. 8*a*. Since each riser has the same height and the same angular offset of 45°, a 360° stepped spiral of sealed air having maximum volume size is formed. FIG. 8*a* is a representation of how such a sealed volume 553 would be illustrated in impeller 13 with risers 27*d*, 27*e*, 27*k* and 27*l* of impeller 14 being shown in broken lines to illustrate how the ends of sealed volume 553 are formed. Each segment of the sealed volume 553 is labeled 153*d*, 153*e*, 53*f*, 53*g*, 53*h*, 53*i*, 53*j*, 253*k* and 253*l* to correspond with the well volume segment in riser series 17 in which it was formed. If a step by step progress of the sealed air volumes were to be followed one would see the next step involving this air volume to be contained in risers 17*e–*18*a* and 27*e–*28*a*. Since compression risers 18*a* and 28*a* have less axial height than intake risers 17*e* and 27*e*, the same mass amount of air is now contained in the impellers along of shorter axial distance than in the previous step. In the second step the same air mass would pass to risers 17*f–*18*b* and 27*f–*28*b* with compression resulting from the shortening of the axial distance which contains the air. The process passes sequentially until an intermediate stage is reached wherein the same mass of air is now contained in wells of risers 17*h–*18*d* and 27*h–*28*d* and the sealed air volume 553 in impeller 13 would have the configuration shown in FIG. 8*b*. Again, each segment of the sealed volume 553 is labeled 153*h*, 153*i*, 53*j*, 53*k*, 53*l*, 53*a*, 53*b*, 253*c* and 253*d* to correspond with the well volume or well volume segment in risers series 17 and 18 in which it was formed. Approximately half of the air has now passed from intake section 38 into compression section 39. In this position compression is only partially complete provided that there are additional compression risers in section 39 which can accept the sealed gas volume axially moving from intake section 38 into compression section 39. Thus, even if the position shown in FIG. 8*b* were the initial sealed volume position, it would still be compressed by axial downstream movement into additional compression risers in section 39. Therefore, as the sequential passage of the sealed air volume continues it will reach the stage where it has completely left intake section 38 and passed completely into compression section 39, e.g., into risers 18*a–i* and 28*a–i*. At that point air volume 553 in impeller 13 has become fully compressed into the minimum volume size and has the configuration shown in FIG. 8*c*. Consistent with FIGS. 8*a* and *b*, each segment of the sealed volume 553 in FIG. 8*c* is labeled 153*a*, 153*b*, 53*c*, 53*d*, 53*e*, 53*f*, 53*g*, 253*h* and 253*i* to correspond with the well volume or well volume segment in risers series 18 in which it was formed. A sealed air volume in impeller 14 would have the same helical configuration as shown in FIGS. 8*a*, *b* and *c* but would be a mirror image due to the opposite rotation of impeller 14 from impeller 13.

The compression ratio may be determined by dividing the maximum volume size shown by FIG. 8*a* by the minimum sealed volume size shown by FIG. 8*c*. Since, in the above description, each riser has the same cross section and differs only in riser height and each section 38 and 39 contains a complete sealed volume the compression ratio may also be determined by dividing the axial distance containing a sealed volume of air in intake section 38 by the axial distance containing a sealed volume of air in compression section 39. In other words, the compression ratio is always stated as the maximum sealed volume size divided by the minimum sealed volume size. Compression ratios of 5:1, 10:1 or even 15:1 and higher may be attained.

Expansion ratios in sections 43 and 44 of FIG. 9 may be determined in the same manner as the compression ratio but in the reverse. The minimum sealed volume size expands into a maximum sealed volume size as the sealed gas passes from expansion intake risers 19*a–l* and 29*a–l* in intake section 43 into expansion risers 20*a–l* and 30*a–l* in expansion section 44. The maximum expanded sealed volume size after expansion divided by the minimum intake sealed volume size is the expansion ratio. As depicted, this ratio is determined by dividing the axial length of the impeller in expansion section 44 containing the maximum sealed volume size by the axial length of the impeller in intake section 43 containing the minimum sealed volume size.

When all risers in a section containing maximum sealed volume are of the same height as in intake section 38 and risers in the minimum sealed volume area are of the same height as in compression section 39 and the cross section of each riser is the same the compression ratio may be easily determined merely by dividing the height of a intake riser 17 or 27 by the height of a compression riser 18 or 28.

The efficiency of the operation of the rotating impellers is also increased in both compression and expansion functions by increasing the rate at which they rotate. The impellers must be free to rotate within the working chambers and the risers thereof, with their various lobes and wells, must also intermesh freely without binding. In order to accomplish this there must be a certain clearance between rotating and intermeshing parts to allow for passage and rotation. The parts will also tend to expand as the internal temperature is raised and allowance must be made to account for the expected degree of expansion. The leakage of gases between closely machined parts may be minimized by precise machining and also by operating at as rapid a rotation as is practical.

FIGS. 2 and 9 are illustrative of the present invention.

As shown in FIG. 2, air, at atmospheric pressure, is brought into working chambers 11 and 12 through inlet 36 by rotation of impellers 12 and 14 by means of power delivered to shaft 16. The intake air passes axially through intake risers 17*a–l* and 27*a–l* of intake section 38, where a sealed volume is formed and compressed in compression risers 18*a–l* and 28*a–l* of compression section 39. As a result the sealed air is adiabatically compressed, for example, at a ratio of about 8:1 as it passes through intake and compression sections 38 and 39 and is expelled into a pressure chamber or other means for use. When used as a fluid motor as shown in FIG. 9, compressed air passes axially into the wells of the intake risers 19*a–l* and 29*a–l* of expansion intake section 43 at constant pressure forming a sealed volume where the sealed air sections are adiabatically expanded in larger volume wells in the expansion risers 20*a–l* and 30*l–l* of expansion section 44 forming the maximum sealed volume and causing work to be delivered to working shaft 16 as mechanical energy. The expanded air is expelled at atmospheric pressure through outlet 37. In the above description each embodiment has been shown with the risers within each section of a compression or expansion function, i.e., 38, 39, 43 and 44, having the same section riser height and angular rotation. There are many variations which may be made to the risers along each impeller without departing from the scope of the invention. Some of the variants which may be utilized are shown in FIGS. 10–15.

Figure 11:
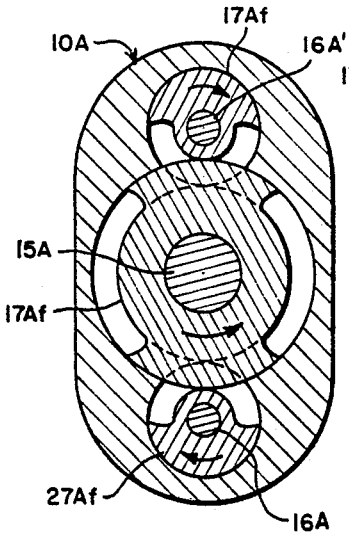
FIG. 11 is a transverse cross sectional view of the first variant taken along lines 11—11 of FIG. 10.
Figure 10:
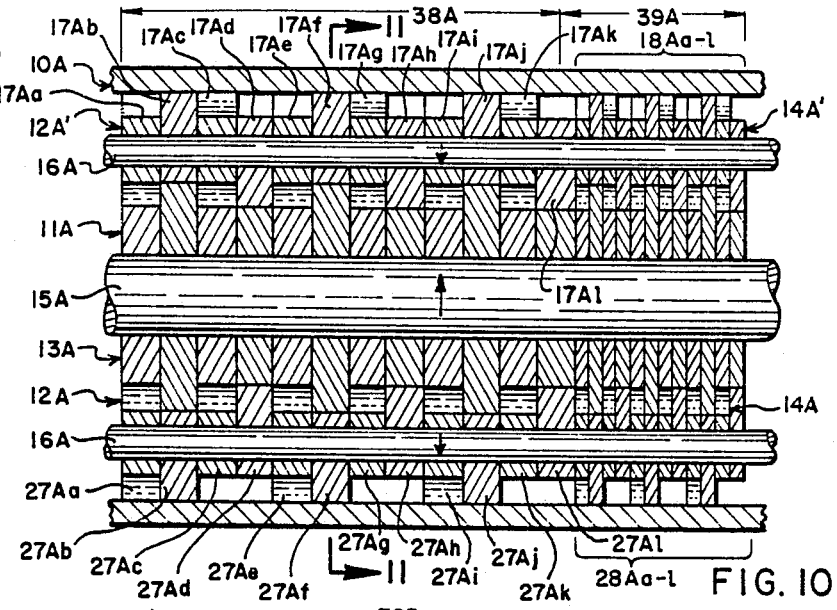
FIG. 10 is a partial longitudinal cross sectional view of a first variant of the invention showing a compressor device made up of three impellers, the outside two being of smaller radius and mating with the center one.

FIGS. 10 and 11 show one variant of an impeller arrangement which consists of a housing 10A containing three working chambers 11A, 12A and 12A'. Disposed in the working chambers are parallel intermeshing impellers 13A, 14A and 14A' mounted on shafts 15A, 16A and 16A' respectively. Impellers 14A and 14A' are identical in structure and are located on either side of central impeller 13A. Only intake riser sections 38A and compression riser sections 39A containing intake risers 17Aa-1 and compression 18Aa-1 on impeller 13A, intake risers 27Aa-1 and compression risers 28Aa-1 on impeller 14A and intake risers 27A'a-1 and compression risers 28A'a-1 on impeller 14A' are shown. As shown in FIG. 11, which is a transverse cross section taken along lines 11—11 of FIG. 10, a riser 17Af on impeller 13A contains two lobes and two wells. The risers 27Af and 27A'f on impellers 14A and 14A' respectively have an outer radius which is only one half of the outer radius of riser 17Af. Risers 27Af and 27A'f each consist of only one lobe and one well. As a result of the difference in radius, impellers 14A and 14A' rotate at twice the speed of central impeller 13A.

FIGS. 10 and 11 actually show three different variants within the scope of the invention, i.e., the number of impellers may vary, the number of lobes and wells on adjacent impellers may vary and the radius of intermeshing impellers may be different.

Figure 13:
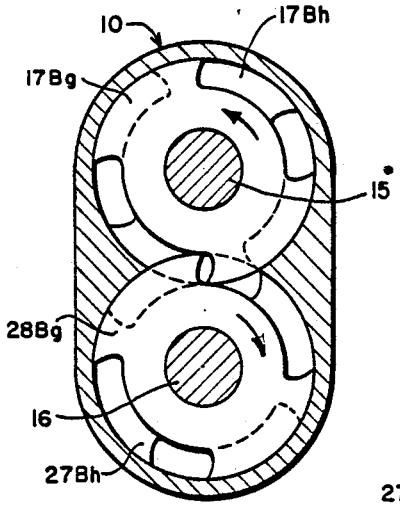
FIG. 13 is a transverse cross sectional view of the second variant taken along the lines 13—13 of FIG. 12 showing the angular rotation.
Figure 12:
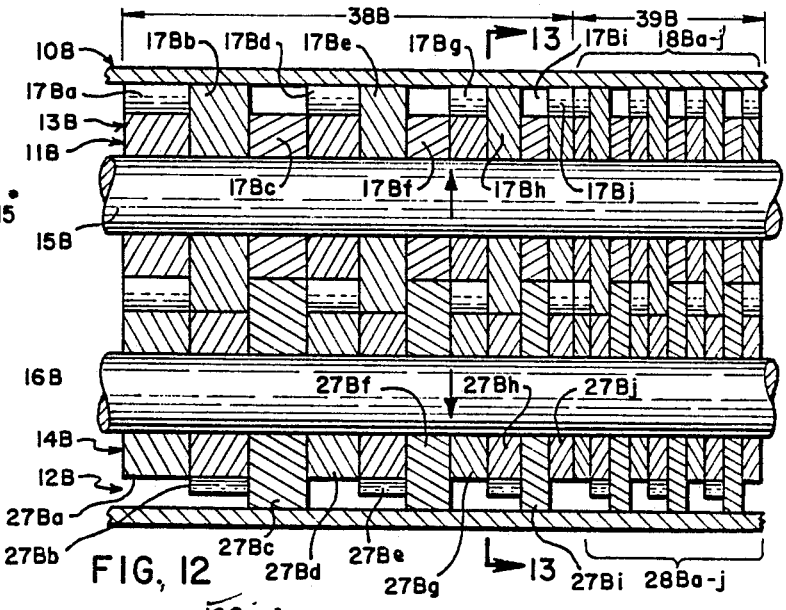
FIG. 12 is a partial longitudinal cross sectional view of a second variant of the invention showing a compressor device wherein the impellers contain risers of varying height and angular rotation of the risers.

FIGS. 12 and 13 are drawn to a second impeller arrangement which also illustrates more than one variable. There is shown in FIG. 12 a portion of a compression section consisting of a housing 10B having two working chambers 11B and 12B having disposed therein two impellers 13B and 14B mounted on shafts 15B and 16B respectively. Risers 17Ba–j and 27Ba–j contained in section 38B diminish in height such that risers 17Ba and 27Ba have the greatest height and risers 17Bj and 27Bj are the thinnest in that section. FIG. 13 is a cross section taken along lines 13—13 of FIG. 12 and show risers 17Bg and 27Bg and underlying risers 17Bh and 27Bh. The underlying risers 17Bh and 27Bh are angularly offset 60° from risers 17Bg and 27Bg. Because of the greater angular offset a complete spiral of wells occurs within each impeller over a fewer number of risers than those shown in FIGS. 1–9. Moreover, with each riser in section 38B diminishing in height in the direction of gas flow the volumetric efficiency may be increased. Obviously one could vary riser height in any section separately or vary angular rotation without varying riser height. These two modifications were shown in one embodiment only for purposes of illustration.

Figure 15:
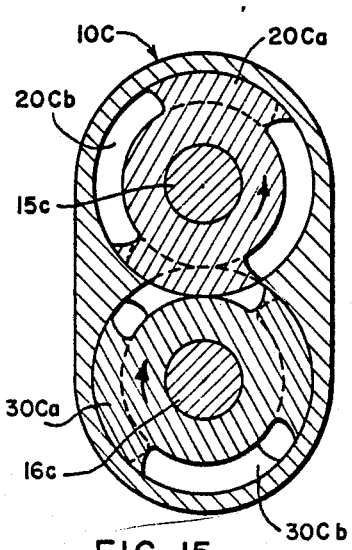
FIG. 15 is a transverse cross sectional view of the third variant taken along lines 15—15 of FIG. 14 showing the maximum angular rotation between adjacent risers.
Figure 14:
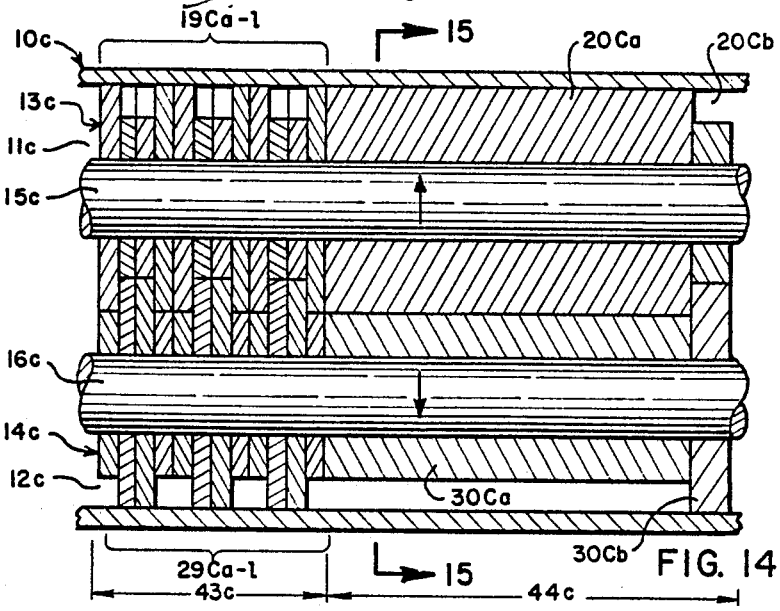
FIG. 14 is a longitudinal cross sectional view of a third variant of the invention showing an expansion device made up of a single riser of considerable axial height and a relatively thin end riser offset at the maximum angular rotation.

A third variant is shown in FIGS. 14 and 15. In this embodiment a partial cross section of expansion intake section 43C and expansion section 44C are shown as comprising a housing 10C, working chambers 11C and 12C in which are disposed impellers 13C and 14C mounted on shafts 15C and 16C.

The expansion intake section 43C is made up of risers 19Ca–l and 29Ca–l, the wells of which contain a sealed volume of a compressed gas in the manner previously described. Expansion section 44C consists of a pair of intermeshing risers 20Ca and 30Ca whose axial heights take up the entire axial length of that section except for a pair of intermeshing, relatively thin valving risers 20Cb and 30Cb. Risers 20Cb and 30Cb are offset from risers 20Ca and 30Ca at the maximum angle as explained in FIG. 7*b*.

In the embodiment shown in FIG. 14, rotation of impellers 13C and 14C enables compressed gases to be sealed into a helical stepped volume within risers 19Ca–l and 29Ca–l. Axial movement of the sealed volume from the rotation of the impellers causes the sealed gases to begin communication with the larger risers 20Ca and 30Ca of expansion section 44C. The gases expand into thse risers in the manner previously discussed in the description of FIGS. 5*a–l* thereby increasing the sealed volume size. However, before the sealed volume can be completely expanded into the larger riser wells, these larger wells come into communication with the wells in the small valving risers 20Cb and 30Cb at the end of section 44C which allows the gases to escape from expansion section 44C.

While the invention has been described in detail in its present preferred embodiment along with certain variants, it will be obvious to those skilled in the art that other changes and modifications may be made to the invention without departing from the spirit or scope thereof. It is therefore intended that the appended claims include all such variations and modifications.

I claim:

1. A rotary expansible chamber device being adapted for compression or expansion of a compressible gas said device comprising:

(a) a housing defining two or more parallel cylindrical working chambers, (b) mating, stepped impellers adapted to axially pass a compressible gas along the length thereof through said working chambers, said impellers being rotatably mounted about an axis in each of said working chambers for rotation in opposite directions to each other, each of said stepped impellers consisting of a plurality of offset risers having an outer and inner radius, each riser of all said stepped impellers having the same peripheral constant cross section and consisting of at least one lobe having at least one well adjacent thereto, said lobes having an arcuate outer surface which defines the outer radius, said wells having an arcuate lower surface which defines the inner radius, said wells also having concave sidewalls, said lobes and wells of adjacent risers along the same impeller being offset angularly from each other in a stepped spiraling relationship opposite the direction of impeller rotation in the direction of axial compressible gas flow along the axis of said impeller with the offset lobes forming spiraling angular steps and the offset wells defining a stepped helical volume, the risers along the axis of said impellers being a predetermined height which height will vary to enable the compression or expansion of a compressible gas within said working chambers, said impellers being mated such that, as said impellers rotate, a compressible gas passing axially through said working chambers will be sealed as a 360° helical stepped gas volume in said helical volume by the rotation of said impellers and remain sealed with a change of sealed helical stepped gas volume size as a result of the angular rotation and variation in riser height as said compressible gas axially traverses through said working chambers, and (c) inlet means in said housing forward of said impellers for introducing a compressible gas into said working chambers and outlet means in said housing aft of said impellers for removing a compressible gas from said working chambers.

2. An expansible chamber device according to claim 1 wherein the concave sidewalls of the wells of said risers are shaped such that said sidewalls begin at the juncture of said sidewalls with the lower arcuate surface of a well and end at the juncture of said sidewall with said outer arcuate surface of a lobe such that each sidewall begins and ends on a radial line extending from the axial center of each riser to the outer radius thereof.

3. An expansible chamber device according to claim 1 wherein said housing contains two parallel cylindrical working chambers housing two impellers.

4. An expansible chamber device according to claim 1 wherein said risers contain two lobes and two wells each.

5. An expansible chamber device according to claim 1 wherein said risers contain three lobes and three wells each.

6. An expansible chamber device according to claim 1 wherein said risers vary continuously in height in said compression section such that the height of the risers decreases in the direction of compressible gas flow.

7. An expansible chamber device according to claim 1 wherein said risers vary continuously in height in said expansion section such that the height of the risers increases in the direction of compressible gas flow.

8. An expansible chamber device according to claim 1 said housing contains three parallel cylindrical working chambers housing three impellers.

9. An expansible chamber device according to claim 8 wherein said impellers consist of a center impeller and two intermeshing side impellers wherein the diameter of said center impeller is greater than the diameter of said side impellers.

10. A expansible chamber according to claim 1 wherein the plurality of risers making up each stepped impeller contained within the working chambers consists of at least an intake series of axially aligned risers and a differential series of axially aligned risers in that order in the direction of compressible gas flow wherein the risers within each series is of uniform height with the risers in the differential series having a different height than the risers in the intake series, said intake and differential series combined consisting of sufficient angularly offset risers to form within the wells thereof at least one sealed 360° helical stepped volume and wherein the sealed helical volume size is change as a function of angular rotation and change in riser height in the direction of compressible gas flow.

11. A expansible chamber device according to claim 10 wherein the differential series of risers is a compression series and the height of the risers in said compression series is smaller than the height of the risers in said intake series.

12. An expansible chamber device according to claim 11 wherein said intake series contains sufficient angularly offset risers to form a 360° sealed helical stepped volume within that series.

13. A expansible chamber device according to claim 11 wherein said compression series contains sufficient angularly offset risers to form a 360° sealed helical stepped volume within that series.

14. An expansible chamber device according to claim 10 wherein the differential series of risers is an expansion series and the height of the risers in said expansion series is greater than the height of the risers in said intake series.

15. An expansible chamber device according to claim 14 wherein said intake series contains sufficient angularly offset risers to form a 360° sealed helical stepped volume within that series.

16. An expansible chamber device according to claim 14 wherein said expansion series contains sufficient angularly offset risers to form a 360° sealed helical stepped volume within that series.

17. A rotary expansible chamber device being adapted for compression or expansion of a compressible gas, said device comprising:

(a) a housing defining two or more parallel cylindrical working chambers, (b) mating, stepped impellers adapted to axially pass a compressible gas along the length thereof through said working chambers, said impellers being rotatably mounted about an axis in each of said working chambers for rotation in opposite directions to each other, each of said stepped impellers consisting of a plurality of offset risers having an outer and inner radius, each riser of all said stepped impellers having the same peripheral constant cross section and consisting of at least one lobe having at least one well adjacent thereof, said lobes having an arcuate outer surface which defines the outer radius, said wells having an arcuate lower surface which defines the inner radius, said wells also having concave sidewalls, said lobes and wells of adjacent risers along the same impeller being offset angularly from each other in a stepped spiraling relationship opposite the direction of impeller rotation in the direction of axial compressible gas flow along the axis of said impeller with the offset lobes forming spiraling angular steps and the offset wells defining a stepped helical volume, the risers along the axis of said impellers being a predetermined height which height will vary to enable the compression or expansion of a compressible gas within said working chambers, said impellers being mated such that, as said impellers rotate, a compressible gas passing axially through said working chambers will be sealed as a 360° helical stepped gas volume in said helical volume by the rotation of said impellers and remain sealed with a change of sealed helical stepped gas volume size as a result of the angular rotation and variation in angular riser offset distance as said compressible gas axially traverses through said working chambers, and (c) inlet means in said housing forward of said impellers for introducing a compressible gas into said working chambers and outlet means in said housing aft of said impellers for removing a compressible gas from said working chambers.

* * * * *